US007813680B2

(12) United States Patent
Masuda et al.

(10) Patent No.: US 7,813,680 B2
(45) Date of Patent: Oct. 12, 2010

(54) DEVELOPING DEVICE, AND IMAGE FORMING APPARATUS AND PROCESS CARTRIDGE COMPRISING THE SAME

(75) Inventors: Katsumi Masuda, Kanagawa (JP); Yoshio Hattori, Kanagawa (JP); Hiroyuki Uenishi, Kanagawa (JP); Yuji Suzuki, Tokyo (JP); Takamasa Ozeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/398,496

(22) Filed: Mar. 5, 2009

(65) Prior Publication Data

US 2009/0245887 A1 Oct. 1, 2009

(30) Foreign Application Priority Data

Mar. 31, 2008 (JP) ..... 2008-091318

(51) Int. Cl.
*G03G 15/09* (2006.01)

(52) U.S. Cl. ..... 399/277; 399/267; 399/276

(58) Field of Classification Search ..... 399/265–267, 399/272–274, 276, 277
See application file for complete search history.

(56) References Cited

U.S. PATENT DOCUMENTS 6,021,295 A * 2/2000 Ochiai et al. ..... 399/275
6,041,207 A * 3/2000 Ishiguro et al. ..... 399/275
6,501,913 B2 12/2002 Hattori et al.
6,507,720 B2 1/2003 Kabumoto et al.
6,591,077 B2 7/2003 Yanagisawa et al.
6,826,381 B2 11/2004 Muramatsu et al.
6,895,203 B2 5/2005 Ozeki et al.
6,904,244 B2 6/2005 Azami et al.
6,917,779 B2 7/2005 Fujimori et al.
6,978,109 B2 * 12/2005 Shoji et al. ..... 399/274
7,003,235 B2 2/2006 Azami et al.
7,010,249 B2 3/2006 Hattori
7,020,421 B2 3/2006 Enoki et al.
7,043,182 B2 5/2006 Sakai et al.
7,095,971 B2 8/2006 Ozeki et al.
7,212,773 B2 5/2007 Sudo et al
7,283,774 B2 10/2007 Ozeki et al.

(Continued)

FOREIGN PATENT DOCUMENTS

JP 2001-42649 2/2001

(Continued)

*Primary Examiner*—Hoang Ngo
(74) *Attorney, Agent, or Firm*—Oblon, Spivak, McClelland, Maier & Neustadt, L.L.P.

(57) ABSTRACT

To downsize a developing device in the developing carrier axial direction without generating image concentration irregularities from recirculation of developer in the magnetic roller end regions, an N2 pole and an N3 pole, which are mutually adjacent having the same polarity (N polarity), and which are for generating a magnetic force for removing from a developing sleeve a developer that has passed through a developing region, are provided on a magnetic roller. Magnets of this developing device, which are for generating a magnetic field to displace to the inside in the axial direction magnetic force lines that cause peeling force in the direction of separation from the developing sleeve to act on developer on the developing sleeve, based on the magnetic force of the N2 pole and the N3 pole, and that pass through the axial direction end regions within a developer separation region on the developing sleeve, are provided on the outside of the magnetic roller.

12 Claims, 20 Drawing Sheets

U.S. PATENT DOCUMENTS

| | | | |
|---|---|---|---|
| 7,457,570 | B2 | 11/2008 | Kasai et al. |
| 7,463,845 | B2 | 12/2008 | Suda et al. |
| 7,466,945 | B2 | 12/2008 | Hattori |
| 7,474,867 | B2 | 1/2009 | Ozeki et al. |
| 2007/0104516 | A1 | 5/2007 | Katoh et al. |
| 2007/0170211 | A1 | 7/2007 | Hattori |

FOREIGN PATENT DOCUMENTS

| | | |
|---|---|---|
| JP | 2006-65217 | 3/2006 |
| JP | 2006-184524 | 7/2006 |
| JP | 2006-293261 | 10/2006 |

* cited by examiner

DEVELOPING DEVICE, AND IMAGE FORMING APPARATUS AND PROCESS CARTRIDGE COMPRISING THE SAME

BACKGROUND OF THE INVENTION

1. Field of the Invention

The present invention relates to a developing device for developing latent images on a latent image carrier using a two-component developer comprising magnetic carrier and toner used in image forming apparatuses such as copiers, facsimile devices, and printers, and also relates to an image forming apparatus and a process cartridge comprising the same.

2. Description of the Related Art

A developer carrier for carrying developer to the developing region opposite the latent image carrier is provided in this type of developing device. Inside the developing sleeve (hollow body), which is formed, for example, in a cylindrical shape, the developer carrier provides magnetic field generation means for generating a magnetic field for using magnetic force to carry the magnetic carrier in the developer on the peripheral surface of that developing sleeve. Toner is electrostatically adsorbed to the magnetic carrier; the toner is transported to the developing region together with the magnetic carrier carried on the peripheral surface of the developing sleeve; and the toner is supplied to the latent image on the latent image carrier in the developing region. The magnetic field generation means has a plurality of magnetic poles along the rotational direction of the developing sleeve. This type of magnetic field generation means includes devices that use an external magnetic field to magnetize various magnetic pole formation locations of a roller-shaped unit formed in a single body, and devices that support individual magnets on a common support such that those magnetic poles are oriented in a specified direction. Developer carried on the peripheral surface of the developing sleeve by the magnetic force of the magnetic field generation means is transported in the direction of the periphery of the developing sleeve (direction of surface movement) by rotating the developing sleeve.

In this type of developing device, developing consumes the toner in the developer as the developer passes through the developing region. For that reason, peeling the developer off of the developing sleeve after development and returning it to the developer housing unit, and constantly drawing up fresh developer onto the developing sleeve and transporting this to the developing region is important for stable developing performance. Specifically, it is important to prevent recirculation, that is, to prevent developer still on the developing sleeve after having passing through the developing region from being re-transported as is to the developing region.

If developer is recirculated in this way, the concentration of the image formed by the developing device is reduced and there is the risk of creating concentration irregularities, and the like. Consequently, in developing devices of the past, for example, in the conventional developing device disclosed in Japanese Unexamined Patent Application No. 2006-293261, in order to peel the developer after development from off the developing sleeve, magnetic poles of the same polarity were arranged adjacent to each other, and a developer separation area was formed between these magnetic poles, in which peeling force was exerted on the developer on the developing sleeve facing from the surface of the developing sleeve to the direction of separation. According to this conventional developing device, because the developer transported to that developer separation area is removed from the developing sleeve by the peeling force and is incorporated into the developer inside the developer housing unit, recirculation can be prevented.

Moreover, in another conventional developing device, as will be described later while referring to the drawings, in configuring the developer carrier, the widths of the end regions of the magnetic roller were broadened as magnetic generation means. Nonetheless, broadening the widths of the end regions of the magnetic roller in this way posed the problem of enlarging the axial dimensions of the developer roller, thereby making it difficult to produce a compact device as is required for the latest types of image forming apparatuses described above, specifically, for the developing devices therein.

The following describes the reason that the aforementioned recirculation of the developer occurs in the axial direction end regions of the developer carrier (magnetic roller end regions) in the region on the developer carrier corresponding to the magnetic field generation means (called the "region corresponding to the magnetic field generation means" hereinafter).

In the central region of the region corresponding to the magnetic field generation means, axial displacement of the lines of magnetic force generated in the axial direction of the developer carrier (simply called "axial direction" hereinafter) is restricted by the magnetic force of the same polarity in the axial direction end region positions on both sides. As a result, in the axial direction central region in the developer separation region on the developer carrier, the peeling force that is acting on the developer has hardly any components in the axial direction. Consequently, in this central region the peeling force acts effectively on the developer, and the developer can be efficiently removed from the peripheral surface of the developer carrier.

In contrast, for the lines of magnetic force generated in the axial direction end regions of the region corresponding to the magnetic field generation means there is little or no magnetic force of the same polarity to restrict displacement to the outside in the axial direction. For that reason, no equilibrium is obtained between the magnetic force of the same polarity present on the inside in the axial direction and the magnetic force of the same polarity present on the outside in the axial direction, and the lines of magnetic force produced in the axial direction end regions are displaced to the outside in the axial direction. Consequently, in the axial direction end regions inside the developer separation region on the developer carrier, the peeling force (force acted in the direction of separation from the developer carrier) acting on the developer is weak and cannot make the peeling force act effectively on the developer, thereby making it impossible to fully remove developer from the peripheral surface of the developer carrier. This appears to be one of the causes of recirculation of developer on the axial direction end regions inside the region corresponding to the magnetic field generation means.

Moreover, in the developer separation region on the developer carrier, the magnetic component facing to the outside in the axial direction that is generated in those end regions may cause the developer to move to the outside region in the axial direction of the developer rather than to the region corresponding to the magnetic field generation means such that the developer adheres to that outside region. However, developer adhering to the outside region is transported together with the surface movement of the developer carrier, and when passing through the developer separation region on the developer carrier, that developer is again drawn back inside the region corresponding to the magnetic field generation means by the magnetic force of the second magnetic pole. This too appears to be one of the causes generating recirculation of developer in the axial direction end regions within the region corresponding to the magnetic field generation means.

Further, this kind of generation of recirculation of developer in the axial direction end regions within the region corresponding to the magnetic field generation means is only in the part where magnetic poles of the same polarity are adjacent to each other. Specifically, in the part where the magnetic poles of differing polarity are adjacent to each other, the lines of magnetic force that come out from one of the magnetic poles turn in toward the magnetic pole close to it, and even when in the axial direction end regions, there are hardly any lines of magnetic force that face to the outside in the axial direction.

Taking this into consideration, in the present invention magnet members are provided in the part outside the magnetic field generation means, and magnetic fields are generated that displace to the inside in the axial direction of the developer carrier the lines of magnetic force that pass through the axial direction end regions within the developer separation region on the developer carrier and that cause peeling force. The orientation of the lines of magnetic force in the axial direction end regions within the developer separation region on the developer carrier can thereby become very nearly orthogonal to the axial direction. Consequently, the peeling force in these end regions is improved, and therefore the peeling force can be effectively applied to the developer even in these end regions, and developer can be efficiently removed from the peripheral surface of the developer carrier. As a result, the axial direction end regions that produce recirculation of developer in the region corresponding to the magnetic field generation means can be reduced in width (length in the axial direction of the developer carrier). Even if the width of the region corresponding to the magnetic field generation means is shorter, the same effective developing width can thereby be realized without generating image concentration irregularities caused by recirculation of developer.

Technologies relating to the present invention are also disclosed in, e.g., Japanese Unexamined Patent Application No. 2006-065217, Japanese Unexamined Patent Application No. 2006-184524, and Japanese Unexamined Patent Application No. 2001-042649.

SUMMARY OF THE INVENTION

In view of the prior art described above, it is an object of the present invention to provide a developing device, and an image forming apparatus and process cartridge equipped therewith, that can be made compact in the axial direction of the developer carrier without generating image concentration irregularities from the recirculation the developer as described above.

In an aspect of the present invention, a developing device comprises a developer carrier, in which magnetic generation means is arranged inside a non-magnetic hollow body, for carrying and transporting two-component developer comprising magnetic carrier and toner on the peripheral surface of the hollow body by a magnetic force of the magnetic field generation means; a developer housing unit that houses the two-component developer to be carried on the developer carrier; and a developer restriction member for restricting a layer thickness of the two-component developer carried on the developer carrier. After being restricted by the developer restriction means, the two-component developer that has been carried on the developer carrier by the magnetic force of the magnetic field generation means from within the developer housing unit, is caused to pass through the developing region opposite a latent image carrier and to return to within the developer housing unit. The magnetic field generation means comprises a first magnetic pole and a second magnetic pole adjacent to each other for generating a magnetic force for removing from the developer carrier the two-component developer that has passed through the developing region. The second magnetic pole is arranged further on the downstream side in a developer transport direction of the developer carrier than the first magnetic pole. On the outside of the magnetic field generation means a magnetic member is arranged that generates a magnetic field for displacing to the inside in the developer carrier axial direction magnetic force lines, which exert on the two-component developer on the developer carrier a peeling force by the first magnetic pole and the second magnetic pole in a direction of separation from the developer carrier, and which pass through developer carrier axial direction end regions within the developer separation region on the developer carrier.

In another aspect of the present invention, a process cartridge supports integrally a latent image carrier and a developing device that transports to a developing region opposing the latent image carrier a two-component developer comprising magnetic carrier and toner and that develops an image by making the toner adhere to the latent image on the latent image carrier, and which is freely attachable to and detachable from an image forming apparatus that finally transfers a toner image, obtained by developing an image by means of the developing device, from the latent image carrier onto a recording medium thereby forming an image on the recording medium. The developing device comprises a developer carrier, in which magnetic generation means is arranged inside a non-magnetic hollow body, for carrying and transporting two-component developer comprising magnetic carrier and toner on the peripheral surface of the hollow body by a magnetic force of the magnetic field generation means; a developer housing unit that houses the two-component developer to be carried on the developer carrier; and a developer restriction member for restricting a layer thickness of the two-component developer carried on the developer carrier. After being restricted by the developer restriction means, the two-component developer that has been carried on the developer carrier by the magnetic force of the magnetic field generation means from within the developer housing unit, is caused to pass through the developing region opposite a latent image carrier and to return to within the developer housing unit. The magnetic field generation means comprises a first magnetic pole and a second magnetic pole adjacent to each other for generating a magnetic force for removing from the developer carrier the two-component developer that has passed through the developing region. The second magnetic pole is arranged further on the downstream side in a developer transport direction of the developer carrier than the first magnetic pole. On the outside of the magnetic field generation means a magnetic member is arranged that generates a magnetic field for displacing to the inside in the developer carrier axial direction magnetic force lines, which exert on the two-component developer on the developer carrier a peeling force by the first magnetic pole and the second magnetic pole in a direction of separation from the developer carrier, and which pass through developer carrier axial direction end regions within the developer separation region on the developer carrier.

In another aspect of the present invention, an image forming apparatus comprises a latent image carrier and a developing device that transports to a developing region opposing the latent image carrier a two-component developer comprising magnetic carrier and toner, and developing an image by making the toner adhere to the latent image on the latent image carrier, and by finally transferring a toner image obtained by development by means of the developing device from the latent image carrier to a recording medium, thereby forming an image on the recording medium. The developing device comprises a developer carrier, in which magnetic generation means is arranged inside a non-magnetic hollow body, for carrying and transporting two-component developer comprising magnetic carrier and toner on the peripheral surface of the hollow body by a magnetic force of the magnetic field generation means; a developer housing unit that houses the two-component developer to be carried on the developer carrier; and a developer restriction member for restricting a layer thickness of the two-component developer carried on the developer carrier. After being restricted by the developer restriction means, the two-component developer that has been carried on the developer carrier by the magnetic force of the magnetic field generation means from within the developer housing unit, is caused to pass through the developing region opposite a latent image carrier and to return to within the developer housing unit. The magnetic field generation means comprises a first magnetic pole and a second magnetic pole adjacent to each other for generating a magnetic force for removing from the developer carrier the two-component developer that has passed through the developing region. The second magnetic pole is arranged further on the downstream side in a developer transport direction of the developer carrier than the first magnetic pole. On the outside of the magnetic field generation means a magnetic member is arranged that generates a magnetic field for displacing to the inside in the developer carrier axial direction magnetic force lines, which exert on the two-component developer on the developer carrier a peeling force by the first magnetic pole and the second magnetic pole in a direction of separation from the developer carrier, and which pass through developer carrier axial direction end regions within the developer separation region on the developer carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Before explaining the present invention, the diagrams will be used to give a detailed description of the prior art of the present invention and the problem points thereof.

As a result of research by the five inventors to meet the recent strong demand for making compact developing devices, they determined that the following kind of problem arises when making the device more compact.

Figure 20:
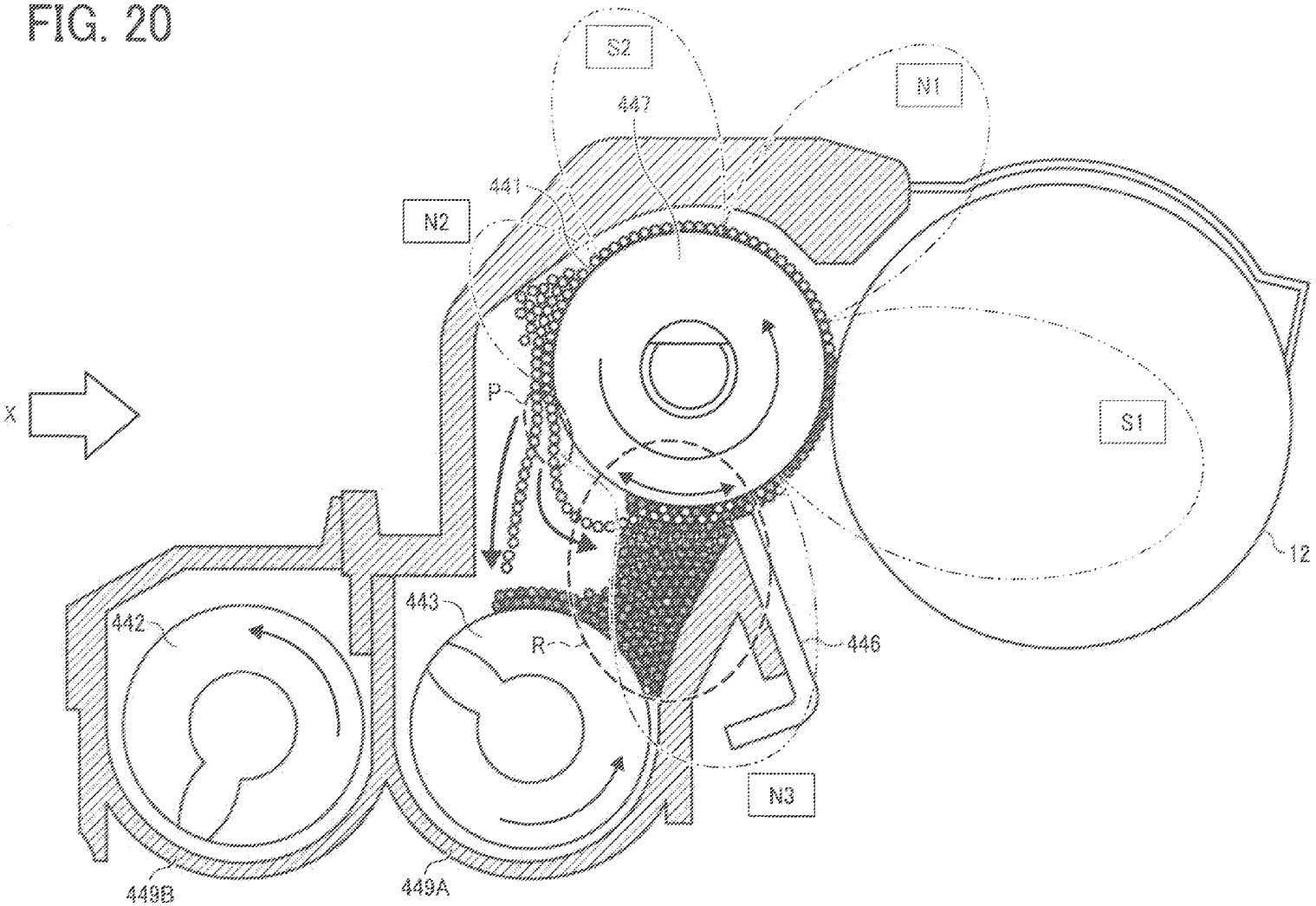
FIG. 20 is a diagram indicating the overall configuration of one example of a developing device configured such that in the drive state the developer separation region on the developing sleeve does not contact the developer in the supply chamber.

FIG. 20 is a diagram indicating the overall configuration of one example of a developing device. Further, the double dotted line in the diagram indicates the distribution of the magnetic flux density in the normal direction (absolute value) on the surface of the developer carrier.

This developing device positions a magnetic roller (magnetic field generation means) 447 inside a non-magnetic developing sleeve (hollow body) 441, and comprises a developer carrier that carries and transports developer on the peripheral surface of a developing sleeve using the magnetic force of the magnetic roller 447. Moreover, also comprised are a developer housing unit that houses the developer, screw shaped agitator transport members 442 and 443 that transport and agitate developer along the direction of the rotational axis of the developing sleeve 441, and developer restriction member 446 that restricts the layer thickness of the two-component developer carried on the developing sleeve 441. The developer housing unit is positioned below the developing sleeve 441, and is divided into a first housing chamber (supply chamber) 449A that extends in the axial direction of the developing sleeve, and a second housing chamber (agitation chamber) 449B that extends in the axial direction of the developing sleeve adjacent to this first housing chamber 449A. Agitation transport members 442 and 443 are provided in the first housing chamber 249A and second housing chamber 249B respectively.

The developer transported to the downstream end (depth side in the diagram) of the first housing chamber 449A by the agitation transport member 443 is moved to the second housing chamber 449B at a place that is not divided, and is transported by the agitation transport member 442 in the second housing chamber toward the downstream end (front side in the diagram) of the second housing chamber 449B. Then, the developer transported to the downstream end of the second housing chamber 449B is moved to the first housing chamber 449A at a place that is not divided, and is transported by the agitation transport member 443 in the first housing chamber toward the downstream end of the first housing chamber 449A. The developer is circulated and transported inside the developer housing unit in this way.

Supplemental toner for replenishing the part of the toner consumed by developing is normally supplied to the developer in the second housing chamber 449B. Five poles are provided in the magnetic roller 447 above, namely, S1 (developing pole), N1, S2 (transport poles), N2 (developer division upstream pole) and N3 (developer division, drawing up and restriction pole) (S1, S2 have the same polarity as each other, for example S polarity. N1, N2and N3 have a different polarity than S1, etc., for example, N polarity. The same applies below.). The developer in the first housing chamber 449A is drawn up on the developing sleeve 441 by the magnetic force of the magnetic roller 447 during transport. Afterwards, the developer drawn up on the developing sleeve 441 is restricted by the developer restriction member 446, and then passes through the developing region opposite to the latent image carrier 12, and is again returned to inside the developer housing unit. Concretely, by rotating the developing sleeve 441 in the direction marked by the arrow in the diagram, the developer on the developing sleeve 441 is transported by he rotation of developing sleeve 441 so as to pass in order through the magnetic poles of developer dividing, drawing up and restricting pole N3, developing pole S1, transport poles N1 and S2, and developer dividing upstream pole N2.

Figure 21:
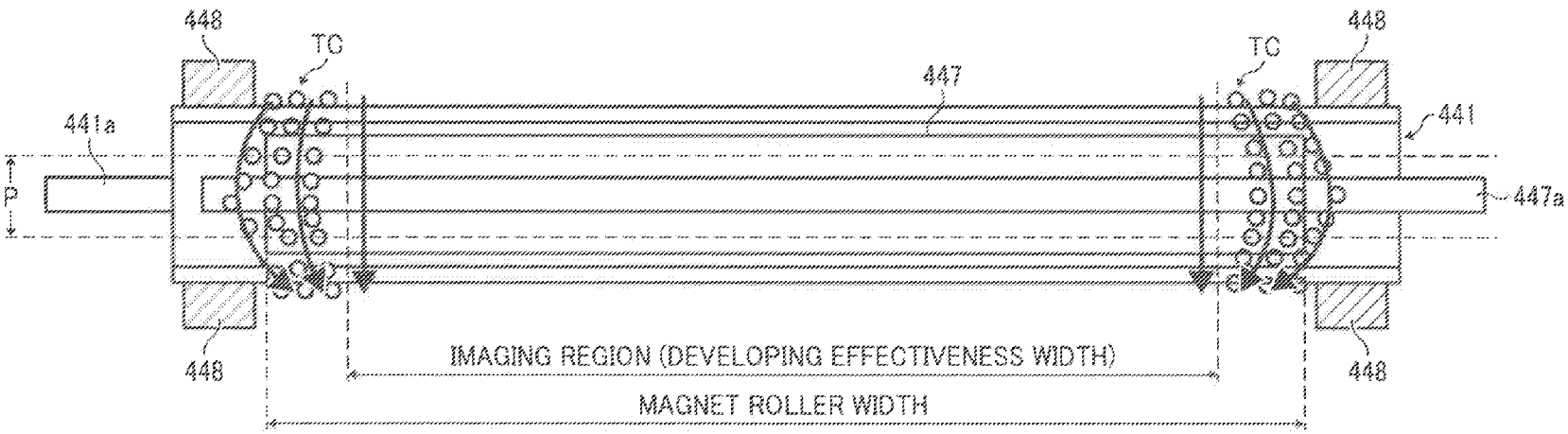
FIG. 21 is a diagram to explain the behavior of developer on the surface of the developing sleeve viewed from the direction of the arrow X in FIG. 20.

FIG. 21 is a diagram for explaining the behavior of the developer on the surface of the developing sleeve 441 when viewed from the direction marked by the arrow X in FIG. 20.

The peeling force by the N2 pole and the N3 pole at the developer separation region P effectively acts on the developer within the width of the developing effectiveness region on the surface of the developing sleeve 441 opposite the image formation region where a latent image can be formed on the latent image carrier 12 (called "developing effectiveness width" hereinafter), and the developer is removed from the surface of the developing sleeve 441. In contrast, as indicated in the diagram, on the parts of the developer sleeve further outside in the axial direction from the developing effectiveness width in the region on the developing sleeve corresponding to the magnetic roller 447 (called the "magnetic roller end regions" hereinafter), the developer adheres to the surface of the developing sleeve, and there is developer that remains without being removed from the surface of the developing sleeve 441. Specifically, recirculation of developer is produced in the magnetic roller end regions. Thereby, when the magnetic roller end regions where this kind of recirculation of developer is produced are also configured to be inside the developing effectiveness width, a reduction of image concentration is produced by the recirculation of developer in both image end parts in the direction corresponding to the axial direction of the developing sleeve, and image concentration irregularities are produced.

A conventional countermeasure to this, as indicated in FIG. 21, was to configure the magnetic roller end regions so as not to be within the developing effectiveness width, so that recirculation of developer in the magnetic roller end regions would not affect the image. This countermeasure, however, prevents the making of a small-scale developing device. The reason is as follows.

Generally, as indicated in FIG. 21, in order to prevent developer inside the developer housing unit from leaking to the outside in the axial direction of the developing sleeve, seal members 448 were used to make seals between the end surfaces of the developing sleeve 441 and the developing casing. Normally, these seal members 448 are provided at positions further to the outside in the axial direction of the developing sleeve than the magnetic roller end regions. The main reason for this is that if the seal members 448 are arranged so as to contact the magnetic roller end regions, the developer attracted by the magnetic force of the magnetic roller 447 is prone to be incorporated between the surface of the developing sleeve 441 and the seal members 448, making it difficult to maintain the seal characteristics over time. Because the dimension of the developing device in the axial direction of the developing sleeve (axial dimensions) are largely determined by the positions of the seal members 448, the broader the width of the magnetic roller end regions, the greater the axial dimensions of the developing device in relation to the developing effectiveness width. Specifically, even if the same developing effectiveness width is set up, the broader the width of the magnetic roller end regions outside the developing effectiveness width, the greater axial dimensions the developing device will have.

An embodiment of the present invention suitable for an electronic photographic type printer (simply called "printer" hereinafter), which is an image forming apparatus, will be explained below.

Figure 1:
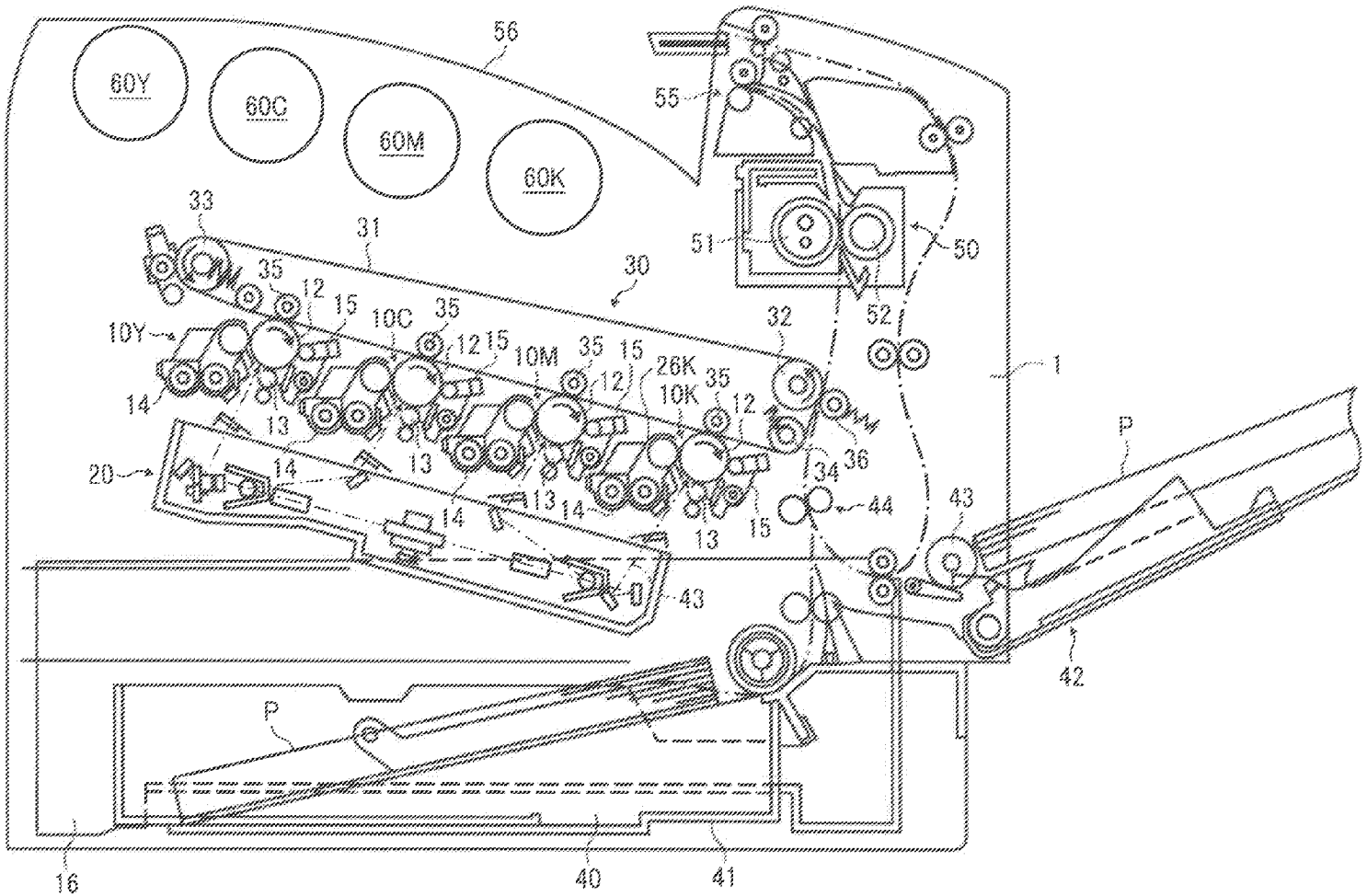
FIG. 1 is a diagram indicating the overall configuration of a printer related to an embodiment of the present invention.

FIG. 1 is a diagram of the overall configuration of a printer related to the present embodiment. Further, Y, C, M, and K indicate the color members yellow, cyan, magenta, and black respectively.

The four imaging devices 10Y, 10C, 10M, and 10K, which are processing cartridges of this printer, are freely attachable and detachable in the image forming station, not indicated in the diagram, formed on the side of the apparatus main unit 1. These use mutually differing colors Y, M, C, and K toner as the image forming substances, but other than that, they all have equivalent configurations, and can be replaced when the use life has expired. Further, this printer comprises an optical unit 20 as light exposure means that can irradiate laser light, an intermediate transfer unit 30, a paper feed unit 40, and a fixing unit 50, etc.

The configurations of the imaging devices 10Y, 10C, 10M, and 10K are mutually equivalent. Each respectively has a photosensitive drum 12Y, 12C, 12M, or 12K as a latent image carrier, a charge device 13Y, 13C, 13M, or 13K that charges the photosensitive drums as process means acting thereon, and a cleaning device 15Y, 15C, 15M, or 15K for removing toner remaining on the photosensitive drum configured in a single body. A developing device 14Y, 14C, 14M, or 14K, which develops the latent image formed on the respective photosensitive drum, is connected to this single unit.

The intermediate transfer unit 30 comprises an intermediate transfer belt 31 as an intermediate transfer body, a plurality (in this case, three) of rollers 32, 33, and 34 that rotatably support the intermediate transfer belt 31, a primary transfer roller 35 that transfers the toner images formed on the various photosensitive drums 12 respectively onto the intermediate transfer belt 31, and a secondary transfer roller 36 that further transfers the toner images transferred onto the intermediate transfer belt 31 onto recording paper P as the recording medium.

The paper feed unit 40 comprises a paper feed roller 43, which transports recording paper P from a paper feed cassette 41 or a manual paper feed tray 42 to the secondary transfer region, and a resist roller 44, etc.

The fixing unit 50 comprises a fixing roller 51 and a pressure roller 52, and a well-known configuration may be adopted to conduct fixing by applying heat and pressure to the toner image on the recording paper P.

Moreover, in the upper part of the apparatus main unit 1, toner bottles 60Y, 60C, 60M, and 60K, which respectively supply supplemental toner to the toner supplement port 145, to be described later, are individually mounted on imaging devices 10Y, 10C, 10M, and 10K so that they can be attached and detached from the apparatus main unit 1.

In this kind of configuration, in the imaging device 10Y of the first color, yellow, the photosensitive drum 12Y is first provisionally charged by the charging device 13Y, and then a toner image is formed by using the developing device 14Y to develop a latent image formed by laser light irradiated from the optical unit 20 as the latent image formation means. The Y toner image formed on the photosensitive drum 12Y is transferred onto the intermediate transfer belt 31 by the action of the primary transfer roller 35Y. The photosensitive drum 12Y that has finished primary transfer is cleaned by the cleaning device 15Y, and is prepared for the next image formation. The remaining toner recovered by the cleaning device 15Y is stored in the waste toner recovery holder 16 that is set up in the direction of removal (direction of axial rotation of the photosensitive drum) of the imaging device 10Y. The waste toner recovery holder 16 can be freely attached and detached from the image forming apparatus main unit 1 so that the holder can be replaced once the storage capacity has been filled. The toner images of the various colors are formed by conducting the same image forming process using the imaging devices 10C, 10M, and 10K for C, M, and K, and the images are transferred by laminating each in order on the toner images formed first. Meanwhile, the toner image formed on the intermediate transfer belt 31 by the action of the secondary roller 36 is transferred onto the recording paper P transported to the secondary transfer region from the paper feed cassette 41 or the manual paper feed tray 42. The recording paper P on which the toner image has been transferred is transported to the fixing unit 50, the toner image is fixed by the nip unit of the fixing roller 51 and pressure roller 52 of this fixing unit 50, and is discharged to the paper discharge tray 56 at the top of the device by a paper discharge roller 55.

Next, the specific configuration of the imaging device will be described.

Other than the differing toner colors used, the configurations of the imaging devices 10Y, 10C, 10M and 10K are equivalent, and therefore the explanation will be given using the imaging device 10Y for yellow as an example.

Figure 2:
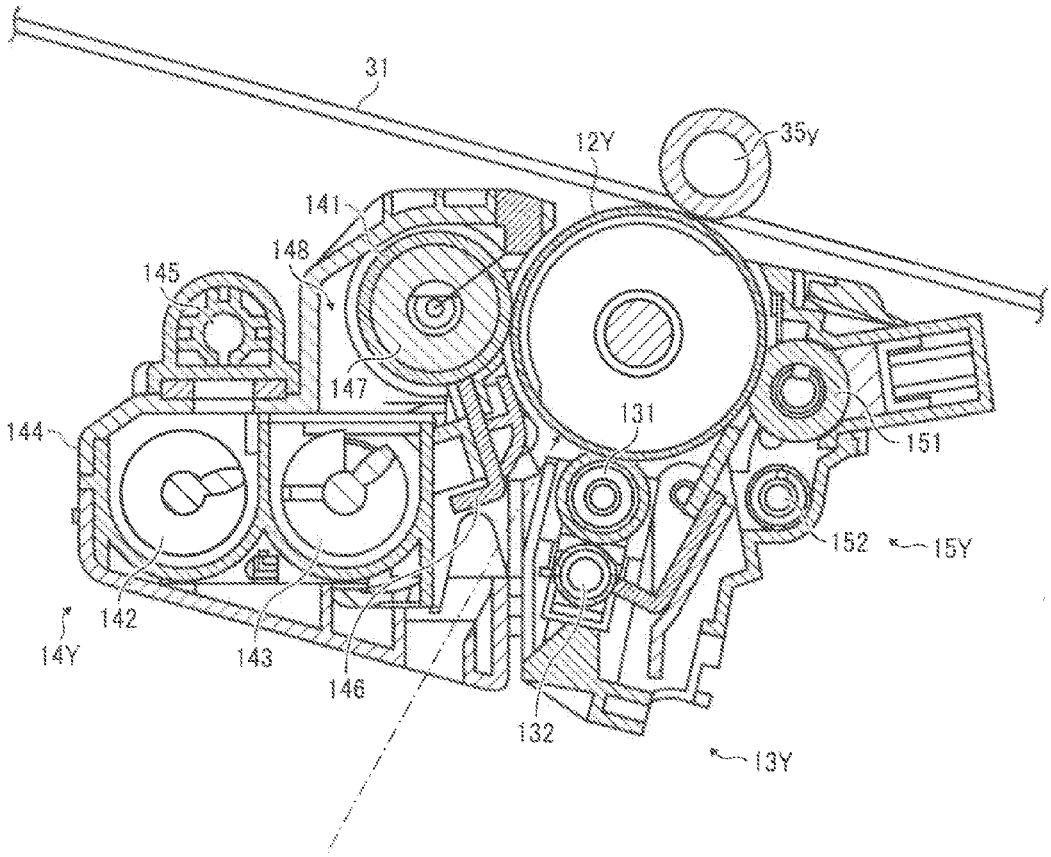
FIG. 2 is a diagram indicating the overall configuration of a yellow imaging device of the same printer.

FIG. 2 indicates the imaging device 10Y for producing a Y toner image.

The charging device 13Y provided in the imaging device 10Y comprises a charging roller 131, and a cleaning roller 132 for cleaning the surface of the charging roller 131. The cleaning device 15Y comprises a cleaning brush 151 and a cleaning blade 152 that contact the surface of the photosensitive drum, and a toner recovery coil 153 that transports toner scraped off by the cleaning brush 151 and the cleaning blade 152 toward the waste toner recovery holder 16.

The developing device 14Y comprises a non-magnetic developing sleeve 141 configured into a hollow bodied developer carrier for carrying and transporting two-component developer comprising magnetic carrier and toner (called simply "developer" hereinafter) to the developing region opposite the photosensitive drum 12Y by rotationally moving counterclockwise in FIG. 2. A magnetic roller 147 is arranged and secured inside the developing sleeve 141 as magnetic field generation means that provides a plurality of magnetic poles circumferentially. The developer carrier is configured by the developing sleeve 141 and the magnetic roller 147. Moreover, arranged opposite the developing sleeve 141, doctor blade 146 is also provided as a developer restriction member for forming between the doctor blade and the surface of the developing sleeve 141*a* doctor gap S for restricting the layer thickness of the toner carried on the surface of the developing sleeve 141. In addition, two transport screws 142 and 143 are provided as agitation and transport members for agitating and transporting back and forth in the axial direction of the photosensitive drum 12Y magnetic carrier housed inside the developing device 14Y and supplemental toner supplied from a toner supplement port 145. These members are housed and supported in the developing casing 144. Specifically, the doctor blade 146 is supported such that it is held against the developing casing 144.

Regarding the doctor blade 146, when supplementing, the doctor blade 146 as shaped in the present embodiment is configured by a doctor base 146*a* formed by a non-magnetic member, and a doctor auxiliary member 146*b* formed by a magnetic member. The doctor base 146*a* mainly fulfills the function of restricting the amount of developer that is transported to the developing region to a given fixed amount, and when restricting the developer, the pressure of the developer is received by the doctor base 146*a*. For that reason, generally this doctor base 146*a* must be guaranteed a thickness (length corresponding to the direction of developer transport by the developing sleeve) that can guarantee a given degree of strength, for example, approximately 1.5 to 2 mm, and a degree of straightness of about 0.05 mm is required at the tip end (end opposing the surface of the developing sleeve). Meanwhile, the doctor auxiliary member 146*b* mainly fulfills the function of increasing the amount of charge of the toner transported to the developing region, and normally is formed of flat metal plate with a thickness much thinner than that of the doctor base 146*a*, for example, about 0.2 mm. In order for the toner charge characteristics to be even across the axial direction of the developing sleeve, the positional relationship of the doctor auxiliary member 146*b* with the surface of the developing sleeve must be precisely maintained across the axial direction of the developing sleeve. Consequently, the doctor auxiliary member 146*b* is installed by spot welding or caulking, etc. to the doctor base 146*a*.

A substance with a circularity of 0.93 or more may be used as the toner of the present embodiment. Specifically, it is known that toner with a smaller particle diameter improves the quality of the image, but when making a smaller particle diameter, the conventional use of pulverized toner yielded a broad particle diameter distribution that was difficult to handle. For that reason, polymerization methods and the like that raise the circularity of the toner and sharpen the particle diameter distribution are generally used to realize high image quality toner. At a minimum, the toner of the present embodiment uses a polymer toner wherein the toner components comprising pre-polymer, colorant and releasing agent are dispersed in aqueous medium in the presence of resin microparticles, and a poly-addition reaction of these toner components can be conducted. Various effects are gained by using this type of toner, such as: there is no pulverization process, resources can be saved, the particle diameter distribution and the charge distribution can be sharpened, and shapes that vary in degree of circularity can be easily controlled.

Further, the toner of the present embodiment preferably has a shape coefficient SF-1 in the range of 100 to 180, and a shape coefficient SF-2 in the range of 100 to 180.

Figure 3:
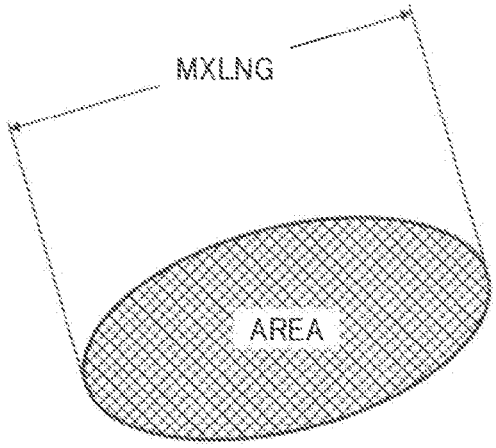
FIG. 3 is a diagram that schematically represents the shape of toner in order to explain the shape coefficient SF-1.
Figure 4:
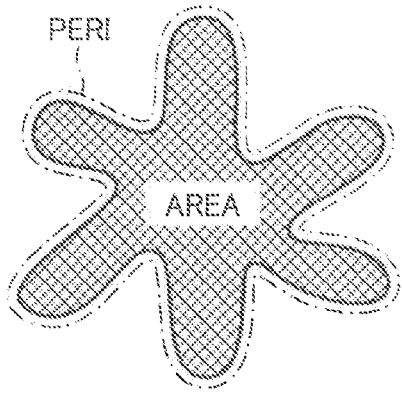
FIG. 4 is a diagram that schematically represents the shape of toner in order to explain the shape coefficient SF-2.

FIG. 3 and FIG. 4 are diagrams that schematically represent the shapes of toner in order to explain the shape coefficient SF-1 and shape coefficient SF-2 respectively.

The shape coefficient SF-1 indicates the percentage of roundness of the toner shape, and is expressed by Eq. (1) below. This is the value derived by taking the square of the maximum length MXLNG of the shape in which the toner can be projected on a two dimensional plane, dividing by the graphic area AREA, and then multiplying by 100π/4.

$$SF\text{-}1\{(MXLNG)^2/\mathrm{AREA}\}\times(100\pi/4) \qquad \text{Eq. (1)}$$

If the value of SF-1 is 100, the shape of the toner is a perfect sphere, and the larger the value of SF-1 the more irregular the shape.

In addition, the shape coefficient SF-2 indicates the percentage of contour of the toner shape, and is expressed by Eq. (2) below. This is the value derived by the taking square of the graphic perimeter PERI of the shape in which the toner can be projected on a two dimensional plane, dividing by the graphic area AREA, and then multiplying by 100π/4.

$$SF\text{-}2=\{(\mathrm{PERI})^2/\mathrm{AREA}\}\times(100\pi/4) \qquad \text{Eq. (2)}$$

If the value of SF-2 is 100, the toner surface has no contours, and the larger the value of SF-2 the more notably the toner surface is contoured.

To measure the shape coefficient, concretely, the toner is photographed by a scanning electron microscope (S-800, manufactured by Hitachi), and this is introduced into and analyzed by an image analysis device (LUSEX3, manufactured by Nireko), and the value is calculated.

When the shape of the toner approaches spherical, the contact state between toner and toner or between toner and photosensitive drum 12 becomes point contact, the fluidity becomes heightened as the adhesive force between toner particles is weakened, and the adsorption force between the toner and the photosensitive drum 12 also becomes weak, thereby heightening the transfer rate. It is preferable that neither of the shape coefficients SF-1 and SF-2 exceed 180 because that would lower the transfer rate.

In addition, it is preferable to use toner with a volume mean diameter of 3 μm or more and 8 μm or less as the toner of the present embodiment in order to reproduce micro-dots of 600 dpi or more. The ratio (Dv/Dn) of the volume mean diameter (Dv) and the number mean particle diameter (Dn) is preferably in the range of 1.00 to 1.40. The closer this ratio (Dv/Dn) is to 1.00 indicates a sharper particle diameter distribution. Toner that has this kind of small particle diameter and particle diameter distribution makes it easier to have uniform distribution in the amount of toner charge, a high quality image with little texturing can be obtained, and a high transfer rate can be obtained even in an electrostatic transfer system.

In addition, a substance that has a volume mean diameter of 20 μm or more and 50 μm or less can be used as the magnetic carrier of the present embodiment. Image particularity can be improved and high quality images can be obtained by using magnetic carrier with a particle diameter in this range. Generally, the gap between the developing sleeve 141 and the photosensitive drum 12Y (developing gap), and the diameter of the magnetic carrier have a great affect on image quality. Thus, in the present embodiment, if the developing gap is for example 0.1 to 0.4 mm and the diameter of the magnetic carrier is 20 to 50 μm, then even superior image quality and developer with few adverse effects are possible. If the developing gap is made too small, the developing electric field between the developing sleeve 141 and the photosensitive drum 12Y becomes too strong, the problem arises that the magnetic carrier all moves onto the photosensitive drum 12Y, and so-called carrier adhesion occurs. Conversely, if the developing gap is too large, the developing electric field becomes too small, the developing efficiency drops, and the edge effect of the electric field on the edge of the imaging unit becomes large, and therefore it is difficult to obtain uniform images. In addition, if the diameter of the magnetic carrier is too small, the size of magnetism of the individual carrier particles becomes too small, the magnetic flux force received from the magnetic roller 147 inside the developing sleeve becomes weak, and carrier adhesion is prone to occur. Conversely, if the diameter of the magnetic carrier is too great, the electric field between the magnetic carrier and the electrostatic image on the photosensitive drum becomes sparse, and therefore a uniform image cannot be obtained.

In addition, the magnetic carrier of the present embodiment has a resin coated film on a magnetic core, and this resin coated film contains a charge regulating agent in the resin component that bridges a thermoplastic resin such as acrylic resin and a melamine resin. By using a magnetic carrier, impact is absorbed, wear is controlled, and a suitable balance can be struck between being able by strong adhesion force to maintain large particles, and the effect of preventing impact on the coating film and cleaning off the spent substance. Consequently, the lifespan of the magnetic carrier can be lengthened, specifically, film wear and depletion can be prevented.

Next, the configuration and action of the developing device will be explained.

Figure 5:
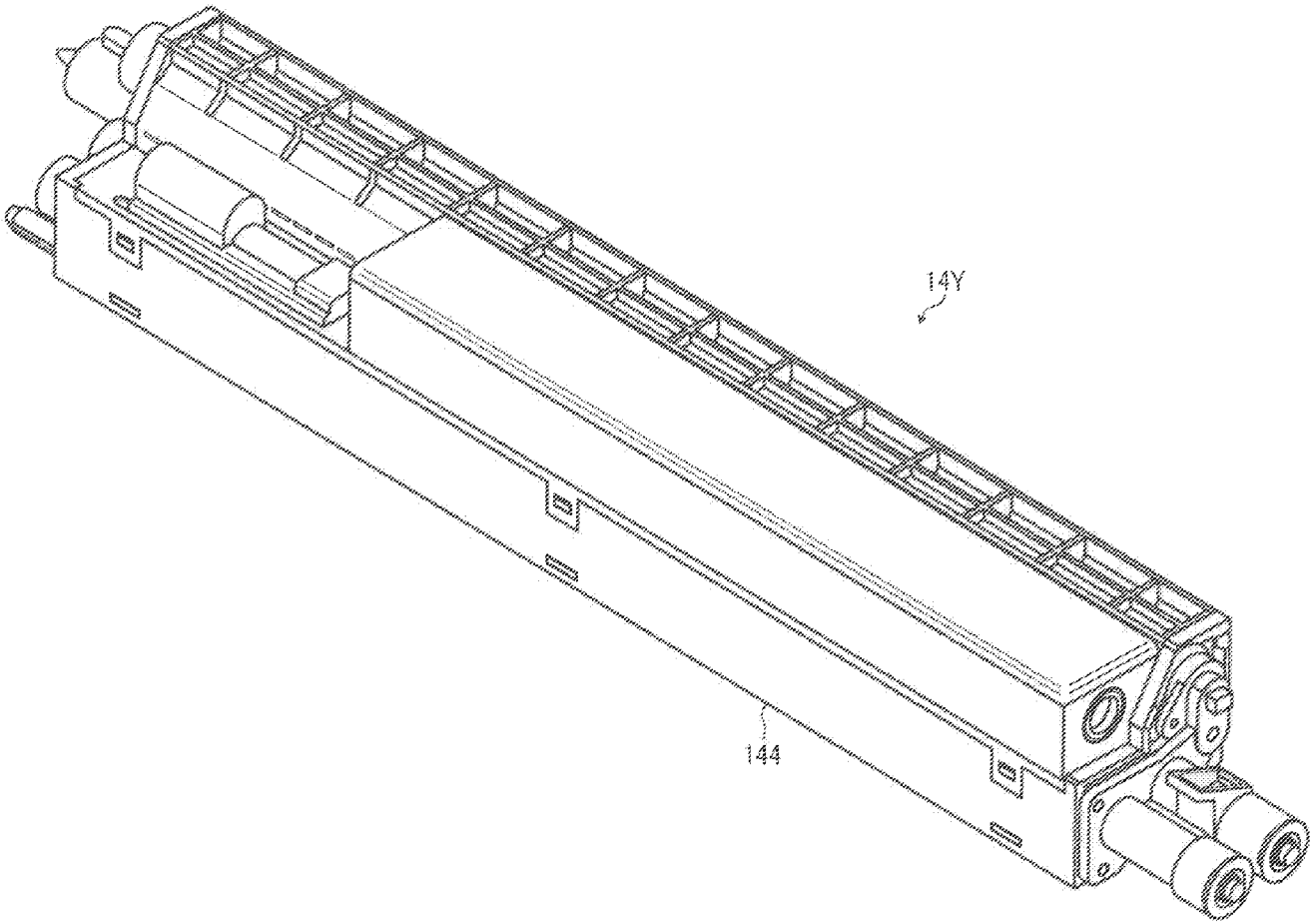
FIG. 5 is a perspective diagram indicating the appearance of a yellow developing device.

FIG. 5 indicates the appearance of the developing device.

Figure 6:
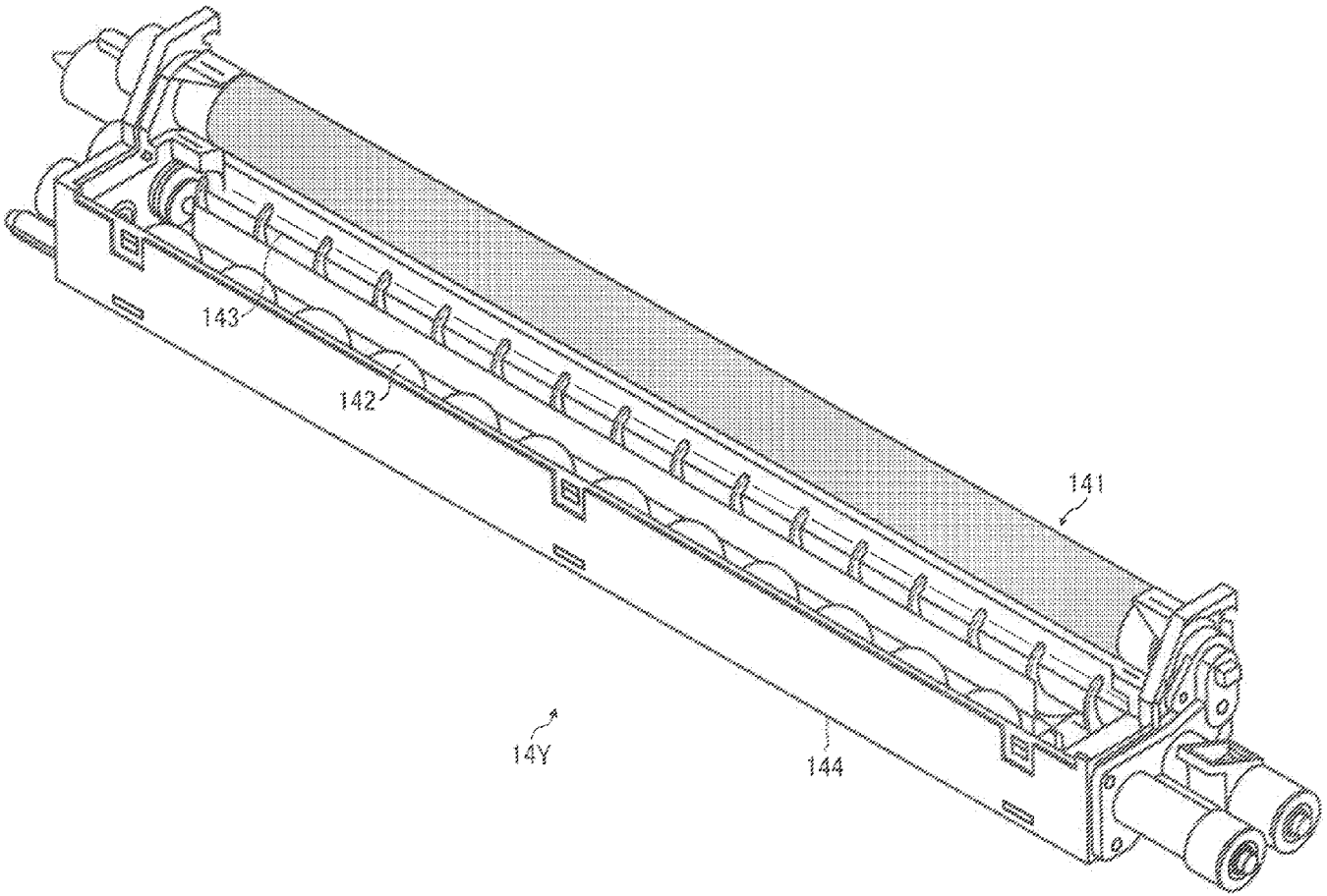
FIG. 6 is a perspective diagram indicating the same developing device with the upper casing removed so that the interior of the developer housing can be seen.
Figure 7:
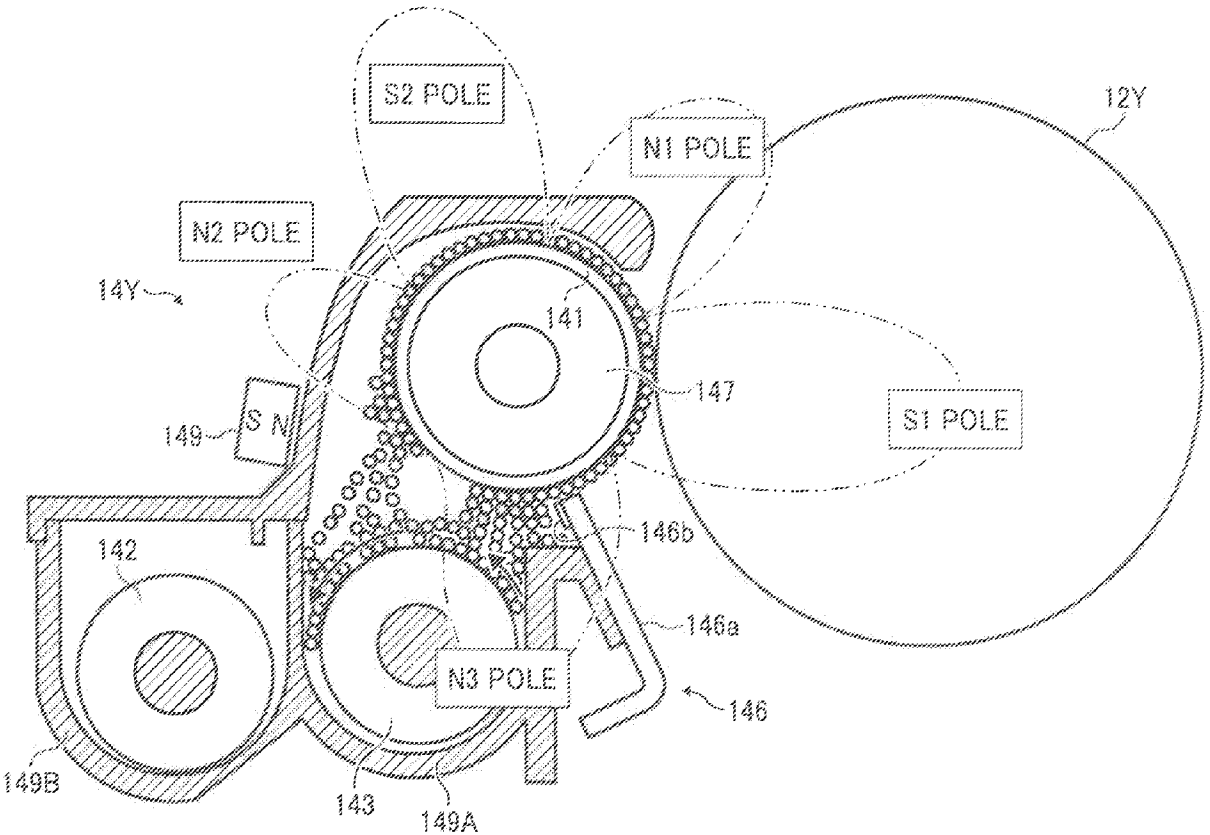
FIG. 7 is diagram indicating with the double dotted line the distribution of the magnetic flux density (absolute value) in the normal line direction on the surface of the developing sleeve together with the overall configuration of the same developing device.

FIG. 6 indicates the state with the upper casing removed so that the interior of the developer housing unit of the developing device can be visually assessed FIG. 7 indicates the overall configuration of the developing device 14Y for yellow of the present embodiment, and the distribution of magnetic flux density in the normal direction (absolute value) on the surface of the developing sleeve 141 is indicated by the double dotted lines.

The magnetic roller 147 of the developing device of the present embodiment has a plurality of magnetic poles formed by magnetization treatment of the peripheral surface by a cylindrical member made of magnetic powder mixed in resin. The diameter of the magnetic roller 147 of the present embodiment is 18 mm. In the present embodiment, following in order from the developing pole S1 opposite the photosensitive drum 12Y counterclockwise in the diagram (direction of transport of developer by the developing sleeve 141), the magnetic poles formed on the magnetic roller 147 are the developing pole S1 (called "S1 pole" hereinafter), transport poles N1, S2 (called "N1 pole" and "S2 pole" respectively hereinafter), developer dividing upstream pole N2 (called "N2 pole" hereinafter), and developer dividing, drawing up, and restriction pole N3 (called "N1" pole hereinafter).

Further, the magnetic roller 147 of the present embodiment is entirely formed in a single body, but may be formed by aligning separately formed magnetic members for each magnetic pole around a spindle. Preferably the type of magnetic roller 147 formed into a single body like that of the present embodiment has magnetic powder dispersed in a resin such as ethylene ethylacrylate or nylon (registered trademark). Strontium ferrite or a rare earth magnet such as such as NDFeB or SmFeN is preferable as the magnetic powder.

Meanwhile, the developing sleeve 141 is a non-magnetic hollow body, and is preferably make of a material like aluminum or stainless steel in terms of processability, cost and durability.

More preferably, a plurality of oval shaped indentations may be randomly provided on the peripheral surface of the developing sleeve 141 by forming multiple random oval shaped strike marks on the peripheral surface of the developing sleeve 141. According to this configuration, by using the indentations on the surface of the developing sleeve 141 to make pitch roughness, slippage can be suppressed since the developer cannot follow the rotation of the developing sleeve 141, thick spikes can be formed based on the individual indentations, and since the indentations undergo little wear, stable and satisfactory images in which no image irregularities are produced can be obtained over a long period of time. This kind of indentation is preferably formed by conventional blast processing, in which the tubular surface of the developing sleeve is impacted with a media comprising comparative large cut wire (metal wire cut into short lengths).

Forming grooves or irregular texture (sandblasting or bead blasting, etc.) on the surface of the developing sleeve is generally conducted in order to make it easier to transport developer. Specifically, in terms of superior image quality surfaces, the mainstream in color image forming apparatuses is a developing sleeve on which texture is formed by blast processing the surface. This kind of roughening treatment such as groove processing or blast processing is conducted in order to prevent reduction of image concentration produced by developer slipping and backing up on the surface of the developing sleeve rotating at high speed.

A developer housing unit is formed in the interior of the developing device 14Y by the developing casing 144. The developer housing unit is positioned below the developing sleeve 141, and is divided into a supply chamber 149A that extends in the axial direction of the developing sleeve, and an agitation chamber 149B that extends in the axial direction of the developing sleeve adjacent to this supply chamber 149A. Transport screws 142 and 143 are provided in the supply chamber 149A and agitation chamber 149B respectively. The developer transported to the downstream end (depth side in the diagram) of the supply chamber 149A by the transport screw 143 is moved to the agitation chamber 149, and is transported by the transport screw 142 in the agitation chamber toward the downstream end (front side in the diagram) of the agitation chamber 149B. Then, the developer transported to the downstream end of the agitation chamber 149B is moved to the supply chamber 149A, and is transported by the transport screw 143 in the supply chamber toward the downstream end of the supply chamber 149A. The developer is circulated and transported inside the developer housing unit in this way. Supplemental toner for replenishing the part of the toner consumed by developing is supplied to the developer in the agitation chamber 149B from a toner supplementation port 145. The developer in the supply chamber 149A is drawn up on the developing sleeve 141 by the magnetic force of the magnetic roller 147 (magnetic force of the N3 pole) during transport. Afterwards, the developer drawn up on the developing sleeve 141 is restricted by the doctor blade 146, and then passes through the developing region opposite to the photosensitive drum 12Y, and is again returned to inside the developer housing unit.

In the present embodiment, the developer adsorbed onto the developing sleeve 141 by being drawn up from within the supply chamber 149A by the magnetic force from the N3 pole is transported counterclockwise in the diagram as the developing sleeve 141 rotates. Development processing is conducted in the developing region by the magnetic force from the S1 pole causing the developer restricted to a specified amount by the doctor blade 146 to spike up, and electrostatically supplying toner from the developer spiked up by the developing electric field onto the surface of the photosensitive drum 12Y. While being maintained on the developing sleeve 141 by the magnetic forces of N1 pole→S2 pole→N2 pole, the developer after development is transported as the developing sleeve 141 rotates. Afterwards, the action of repelling magnetic force produced between the N2 pole and the N3 pole (peeling force) and centrifugal force are received, the developer is separated (peeled) from the developing sleeve 141, and falls into the supply chamber 149A in the developer housing unit.

Further, the magnetic force is calculated by the following equations.

$$Fr=G\times(Hr\times(\partial Hr/\partial r)+Hr\times(\partial H\theta/\partial r))$$

$$F\theta=G\times(1/r\times Hr\times(\partial Hr/\partial\theta)+1/r\times(Hr\times\partial H\theta/\partial\theta))$$

Here, "Fr" indicates the component of magnetic force in the normal direction on the surface of the developing sleeve; "Fθ" indicates the component of magnetic force in the linear direction on the surface of the developing sleeve (called the "normal direction magnetic force" hereinafter); "Hr" indicates the component of magnetic flux density in the normal direction on the surface of the developing sleeve (called the "linear direction magnetic force" hereinafter); and "Hθ" indicates the component of magnetic flux density in the linear direction on the surface of the developing sleeve. Further, "r" is the calculated radius, and "G" is the constant ($7.8\times10^{-15}$).

In the following explanation, when the magnetic force Fr in the normal direction indicates a positive value, the magnetic force acts in the direction to separate the magnetic carrier from the developing sleeve 141, and when the magnetic force Fr in the normal direction indicates a negative value, the magnetic force acts in the direction to adsorb the magnetic carrier on the developing sleeve 141.

Moreover, in the explanation below, simply saying "upstream" and "downstream" means "upstream" and "downstream" in the direction of developer transport by the developing sleeve 141.

As indicated in FIG. 7, in the present embodiment, the N3 pole, which has the same polarity as the N2 pole and is adjacent thereto, is arranged in a position near the doctor blade 146. For that reason, there is no magnetic field polarity change point on the developing sleeve up to where the developer drawn up on the developing sleeve 141 is restricted by the doctor blade 146. Developer stress upstream of the doctor blade 146 can thereby be reduced compared to a developing device that has this kind of polarity change point (refer to FIG. 19).

Moreover, in the present embodiment, the developer separation region P to be restricted to the developing sleeve 141, specifically, the region on the developing sleeve where the peeling force acts on the developer on the developing sleeve 141 based on the magnetic forces of the N2 pole and the N3 pole in the direction of separation from the developing sleeve 141, is configured so as not to contact the developer in the supply chamber 149A. Concretely, the developing sleeve 141 is moved further upward than in the past, and in the drive state, the developer separation region P on the developing sleeve 141 does not contact the developer in the supply chamber 149A. As a result, no situation arises in the developer separation region P in which developer remaining on the developing sleeve 141 is scraped off by the developer in the supply chamber 149A. Consequently, developer stress can be further reduced than in conventional devices configured such that the developer separation region P contacts the developer in the supply chamber 149A.

Meanwhile, the developer in the supply chamber 149A that would have functioned as scraping means in the aforementioned conventional device no longer makes contact with the developer separation region P in the present embodiment, and therefore unless the developer can be fully peeled off from the developing sleeve 141 while passing through the developer separation region P, recirculation will occur. Moreover, the developer in the supply chamber 149A that had been contacted in the developer separation region P in the aforementioned conventional device functioned as a region where the developer separated from the developing sleeve 141 in the developer separation region P was captured by the magnetic force of the N3 pole and drawn toward the developer draw up region (the developer draw up region adjacent to the downstream side of the developer separation region P on which drawing force is exerted by the magnetic force of the N3 pole) and as a wall for preventing re-adherence to developer being drawn to that region, but in the present embodiment there is no developer that forms this kind of wall. As a result, in the present embodiment, unless the developer peeled off in the developer separation region P is separated up to a location fully apart from the developer draw up region, re-adherence will occur.

Thus, in the present embodiment the magnetic flux density Hr in the normal direction within the developer separation region P to be restricted to the developing sleeve 141 is oriented toward an N polarity (a positive value) that is the same as that of the N2 pole and the N3 pole across the entire region of the developer separation region P, and does not have a maximum point. As to be described later, the peeling force can thereby act efficiently on the developer adhering on the developing sleeve 141 within the developer separation region P, and even if developer that is scratched off in the developer separation region P and could be expected to have an effect does not make contact with developer that forms a wall against re-adhesion, recirculation and generation of re-adhesion can be effectively controlled.

Figure 8:
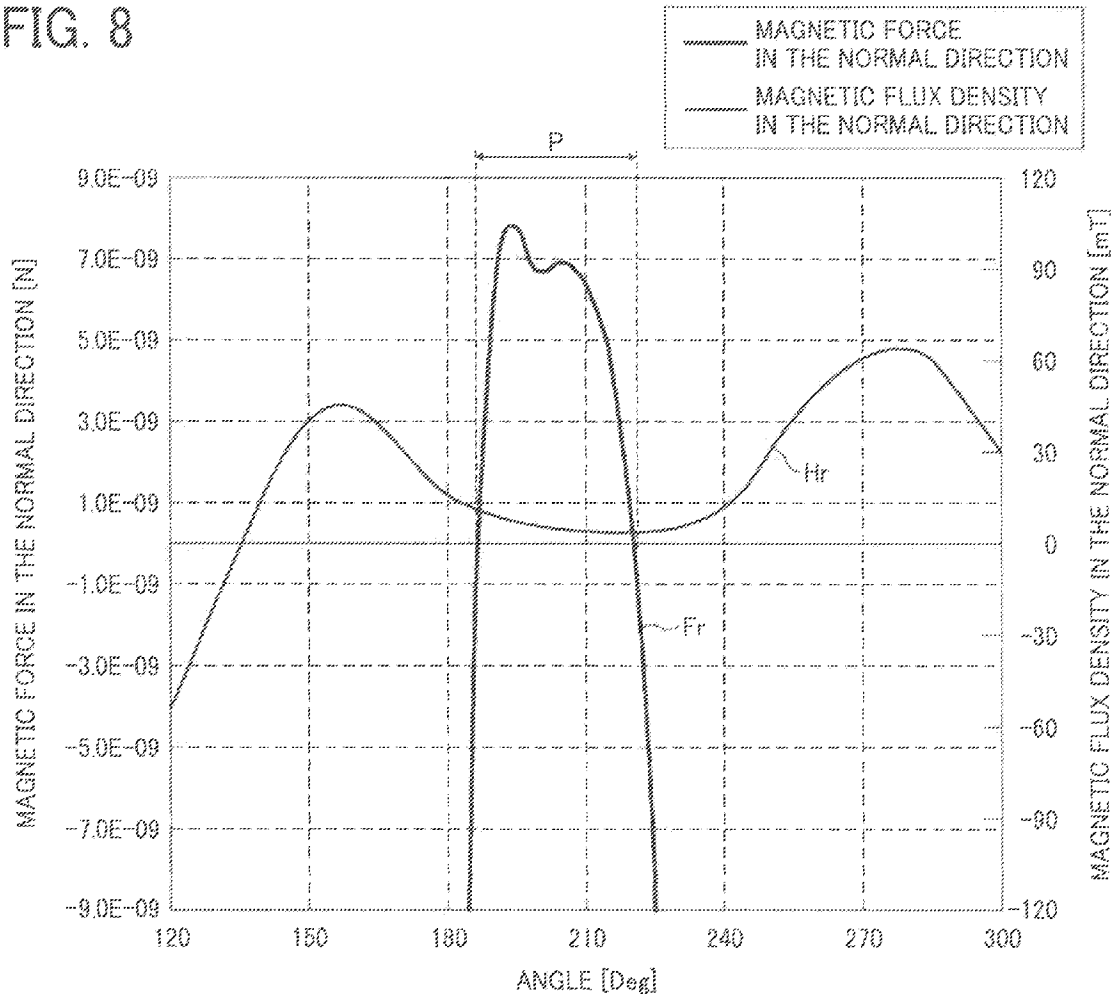
FIG. 8 is a graph indicating the magnetic flux density in the normal direction on the surface of the developing sleeve on the perimeter of the developer separation region of same developing device (fine line), and the magnetic force in the normal direction on the surface of the developing sleeve (thick line)

FIG. 8 is a graph indicating the magnetic flux density in the normal direction on the surface of the developing sleeve 141 on the perimeter of the developer separation region P of the present invention (fine line), and the magnetic force in the normal direction on the surface of the developing sleeve 141 (thick line).

Figure 9:
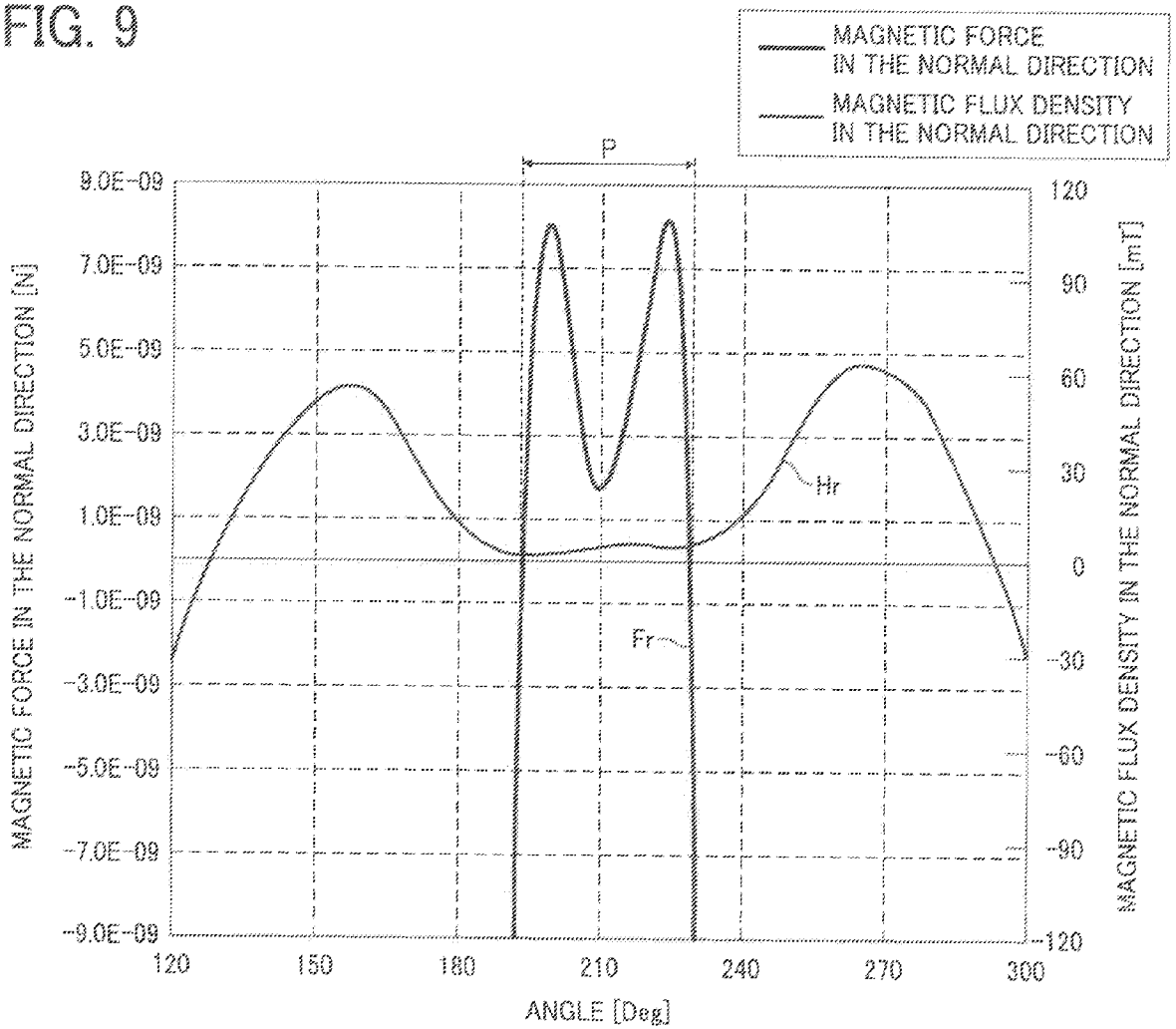
FIG. 9 is a graph indicating the magnetic flux density in the normal direction on the surface of the developing sleeve on the perimeter of the developer separation region of a comparative device (fine line), and the magnetic force in the normal direction on the surface of the developing sleeve (thick line)

FIG. 9 is a graph indicating the magnetic flux density (fine line) of a comparative device in the normal direction on the surface of the developing sleeve 141 on the perimeter of the developer separation region P, and the magnetic force in the normal direction on the surface of the developing sleeve 141 (thick line).

In these graphs, the region where the magnetic force in the normal direction (thick line) has a positive value is the developer separation region P.

Further, the angles indicated on the horizontal axes of these graphs take as 0° the ground point on the developing sleeve 141 where the magnetic flux density in the normal direction of the S1 pole is greatest, and the ground point on the developing sleeve 141 is expressed in degrees with the assumption that the direction of developing sleeve rotation (counterclockwise direction in the diagrams) is positive.

In the comparative device, the developing sleeve 141 is simply moved further upward than in the conventional device, and in the drive state, the developer separation region P on the developing sleeve 141 does not contact the developer in the supply chamber 149A. As indicated in FIG. 9, this comparative device is configured such that the magnetic force Fr in the normal direction, which is the peeling force in the developer separation region P, has two maximum points. Thus, when the developer is peeled from the developing sleeve 141 in the developer separation region P, there is great loss of magnetic force at the area where the minimum point between these maximum points has greatly dropped (to about 25% of the maximum magnetic force in the normal direction within the developer separation region P). Then, when researching this, the inventors found the following reason for the area where the minimum point of the magnetic force Fr in the normal direction drops so greatly. Specifically, in the comparative device, a weak N polarity exists between the N2 pole and the N3 pole, which should prevent producing a reversal ground point wherein drawing force that draws developer is generated by reversing the magnetic flux density in the normal direction between the N2 pole and the N3 pole. The magnetic flux density Hr in the normal direction within the developer separation region P to be restricted to the developing sleeve 141 is thereby oriented toward an N polarity (positive) that is the same as that of the N2 pole and the N3 pole across the entire developer separation region P, and no drawing force is generated that draws the developer within the developer separation region P toward the developing sleeve. However, because there is this kind of weak N polarity as indicated in FIG. 9, a slight maximum point is generated in the area corresponding to the weak N polarity. Then, it was demonstrated that the slight maximum point is a major factor that makes the minimum point area of the magnetic force Fr in the normal direction drop so greatly.

Then, as indicated in FIG. 8, the present embodiment is configured to have no maximum point while the magnetic flux density Hr in the normal direction within the developer separation region P to be restricted to the developing sleeve 141 is oriented to an N polarity (positive value) that is the same as that of the N2 pole and the N3 pole across the entire developer separation region P.

An example of the manufacturing method of a magnetic roller 147 having this kind of magnetic flux density distribution in the normal direction will be explained below.

Figure 10:
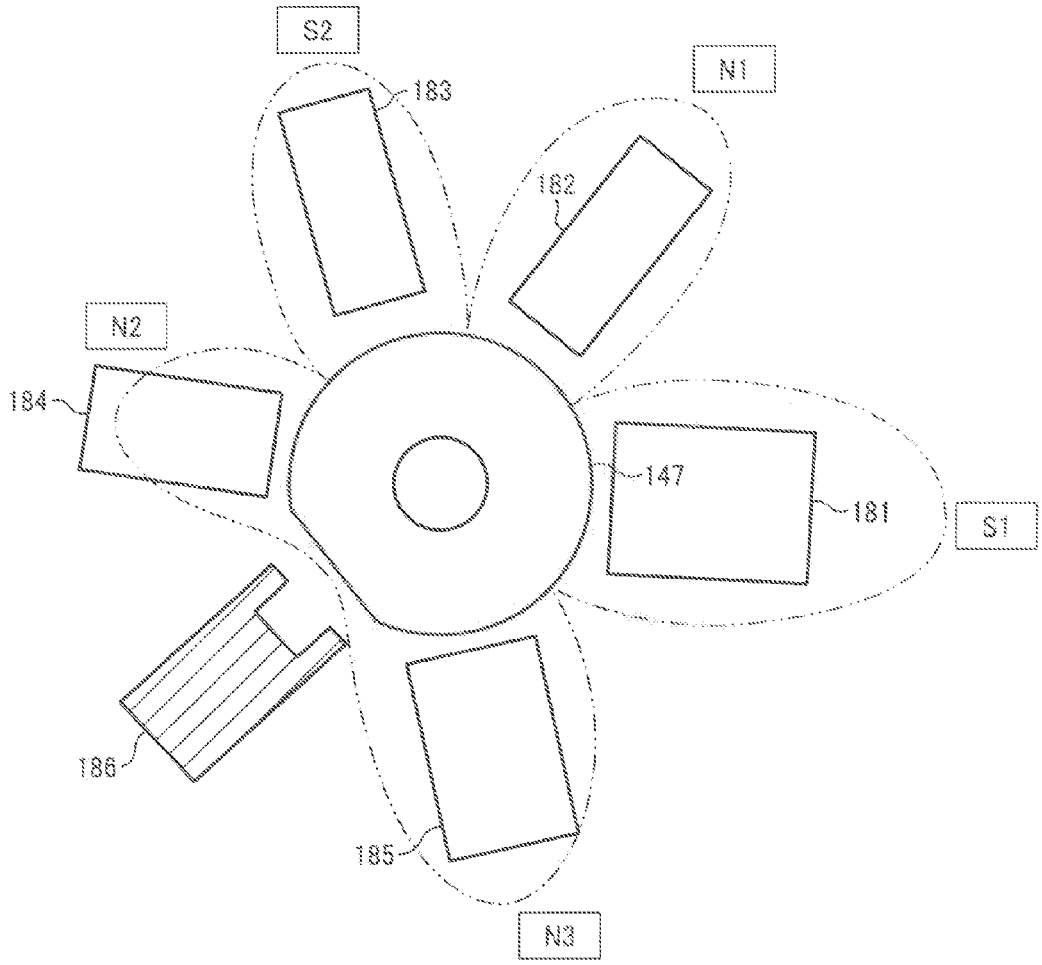
FIG. 10 is a diagram to explain the magnetization process when manufacturing a magnetic roller of a developing device of the present embodiment.
Figure 11:
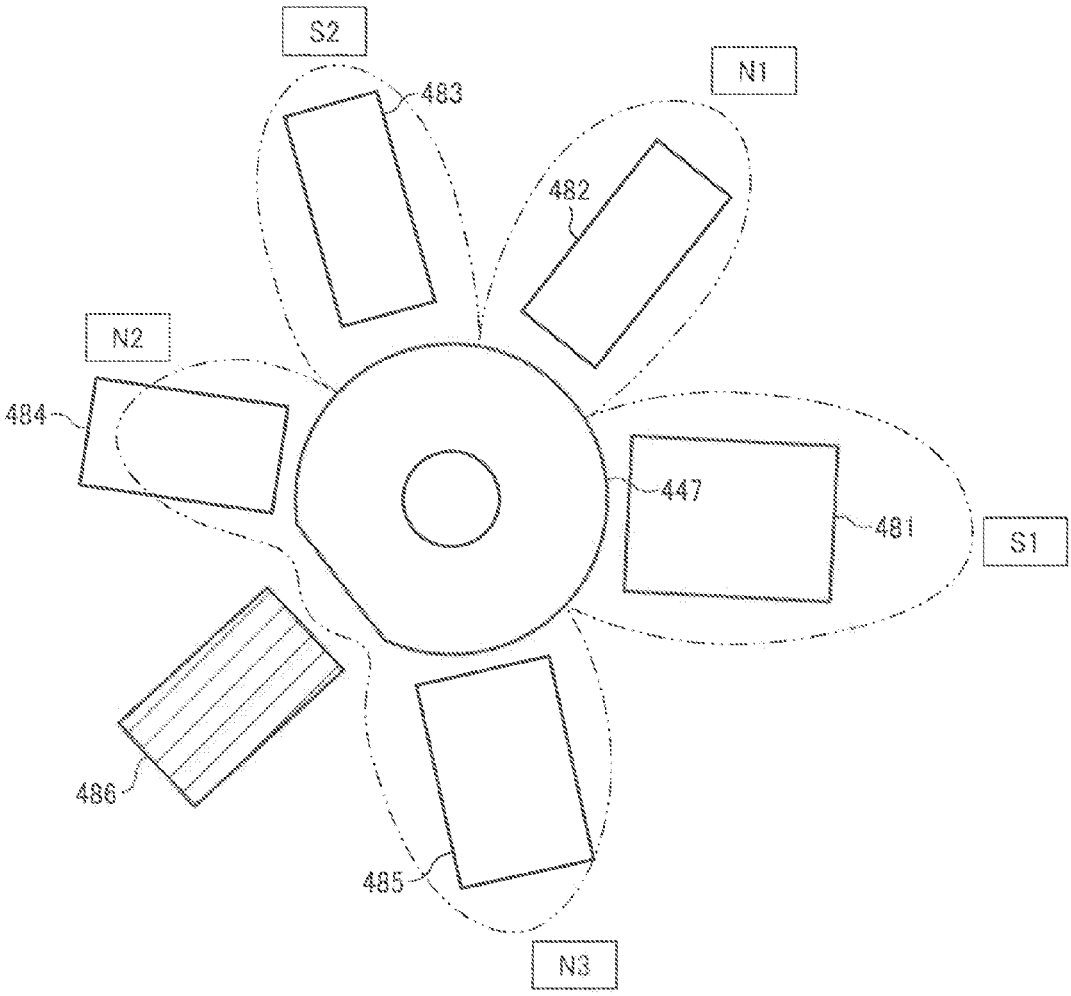
FIG. 11 is a diagram to explain the magnetization process when manufacturing a magnetic roller of a comparative device.

FIG. 10 is a diagram to explain the magnetization process when manufacturing a magnetic roller 147 of the present embodiment; and FIG. 11 is a diagram to explain the magnetization process when manufacturing a magnetic roller 447 of the comparative device.

Both magnetic rollers 147 and 447 undergo magnetization processing by orienting a cylindrical member that mixes magnetic powder in resin so as to face opposite magnetization yokes 181 to 186 or 481 to 486 positioned around the periphery, and the S1 pole, N1 pole, S2 pole, N2 pole and N3 pole are formed. The magnetization yokes 181 to 186 or 481 to 486 corresponding to the magnetic poles differ respectively in the magnetic force and shape dimensions, etc. depending on the width of magnetic pole and the strength of magnetic field to be formed. As indicated in FIG. 11, magnetization yoke 486 for forming a weak N polarity between the N2 pole and the N3 pole in the comparative device has the strongest magnetization in the central area because the surface part that opposes the peripheral surface of the magnetization roller 447 is a flat surface equivalent to those of the other magnetization yokes. For that reason, when attempting to reliably magnetize the magnetic flux density Hr in the normal direction within the developer separation region P to be restricted to the developing sleeve 141 by orienting toward an N polarity (positive value) that is the same as that of the N2 pole and the N3 pole across the entire region of the developer separation region P, there is a maximum point in both cases as indicated in FIG. 9 and FIG. 11.

Thus, in the present embodiment, a magnetization yoke 186 like that indicated in FIG. 10 is used to form a weak N polarity between the N2 pole and N3 pole. Concretely, among the opposing surface areas opposite the peripheral surface of the magnetic roller 147, a magnetization yoke 186 is used which is shaped such that the central part is positioned further from the peripheral surface of the magnetic roller 147 than the other parts. Because the magnetization of the central part can thereby be weakened, it is possible to magnetize such that the orientation toward an N polarity (positive value) is the same as that of the N2 pole and the N3 pole across the entire region of the developer separation region P, and there is no maximum point as indicated in FIG. 8 and FIG. 10.

Further, the manufacturing method of the magnetic roller 147 indicated here is one example, and other methods may be adopted as long as the manufacturing method can ensure an orientation of an N polarity (positive value) that is the same as that of the N2 pole and the N3 pole across the entire region of the developer separation region P, and that there is no maximum point.

Moreover, it is also possible to adopt a configuration such that the magnetic roller 147 moves in coordination with a magnetic member around it, as long as the an orientation of an N polarity (positive value) can be made that is the same as that of the N2 pole and the N3 pole across the entire region of the developer separation region P, and there is no maximum point.

According to the present embodiment, the magnetic flux density Hr in the normal direction inside the developer separation region P has no maximum point as indicated in FIG. 8, and therefore the drop of the minimum point part of the magnetic force in the normal direction (peeling force) Fr that has a positive value, which becomes loss when peeling developer from the developing sleeve 141 in the developer separation region P, can be minimized. Concretely, the drop of the magnetic force in the normal direction (peeling force) Fr at the minimum point can be controlled to stop at about 90% of the maximum. Further, if the drop can be controlled such that the size of the magnetic force in the normal direction (peeling force) Fr at the minimum point is 50% or more of the maximum value, even if there is no developer that can be expected to have the abrading effect within the developer separation region P or developer that is a wall against re-adhesion, generation of recirculation and re-adhesion can be effectively suppressed, and deterioration of image quality by recirculation and re-adhesion can be effectively prevented.

Figure 12:
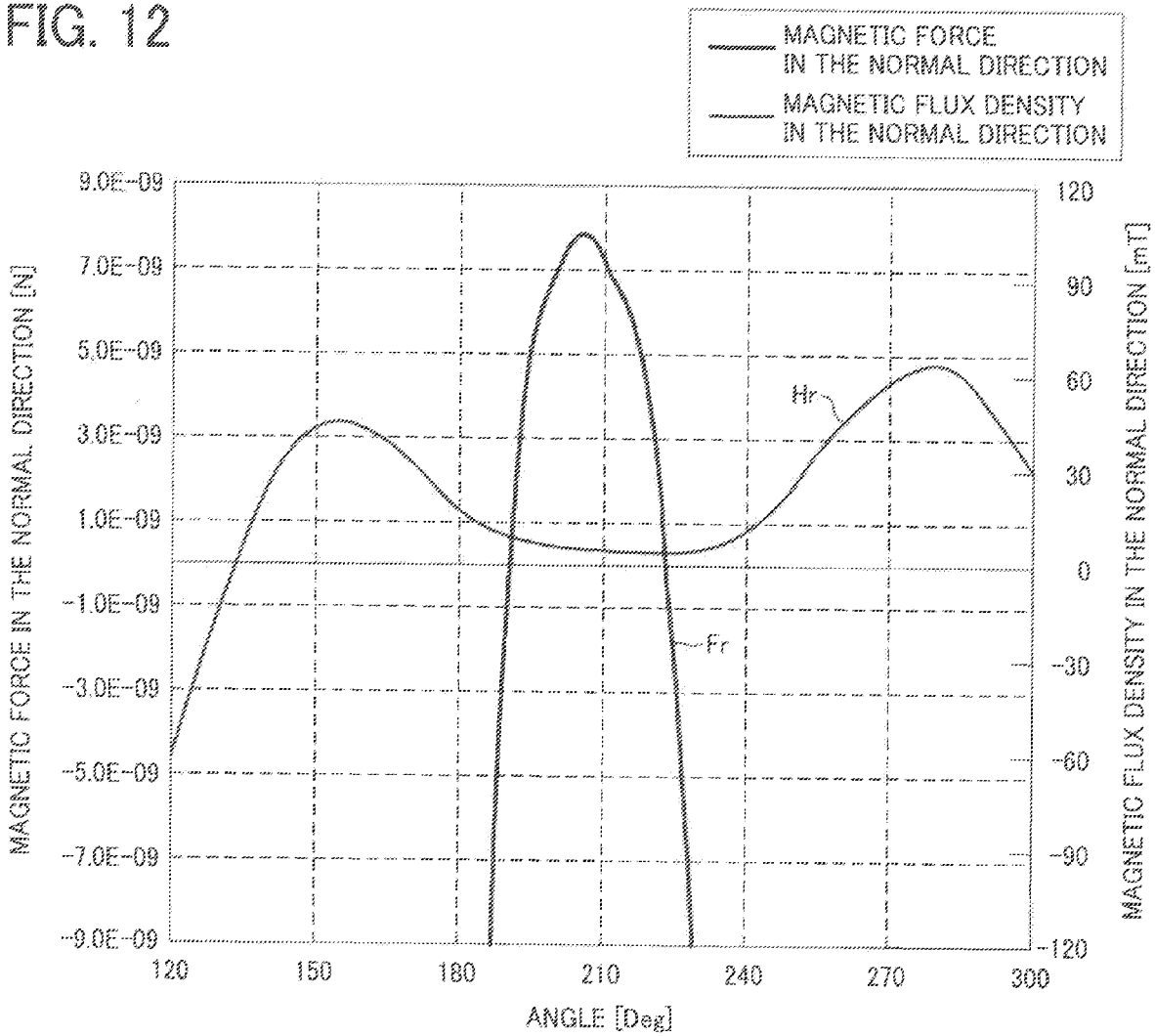
FIG. 12 is a graph indicating the magnetic flux density in the normal direction on the surface of the developing sleeve on the perimeter of the developer separation region related to another configuration (fine line), and the magnetic force in the normal direction on the surface of the developing sleeve (thick line)

Further, as indicated in FIG. 12, a device may be configured such that the magnetic force in the normal direction (peeling force) Fr within the developer separation region P has a single maximum point. Concretely, in order to have this kind of configuration, the magnetization processing of the various magnetic poles of the magnetic roller 147 is adjusted. According to this configuration, there is no minimum point of the magnetic force in the normal direction (peeling force) Fr as indicated in FIG. 8, and no temporary drop in the magnetic force in the normal direction Fr is generated within the developer separation region P, and therefore, loss when peeing developer from the sleeve 141 in the developer separation region P can be kept to a minimum. Consequently, deterioration of image quality by recirculation and re-adhesion can be effectively prevented.

Figure 13:
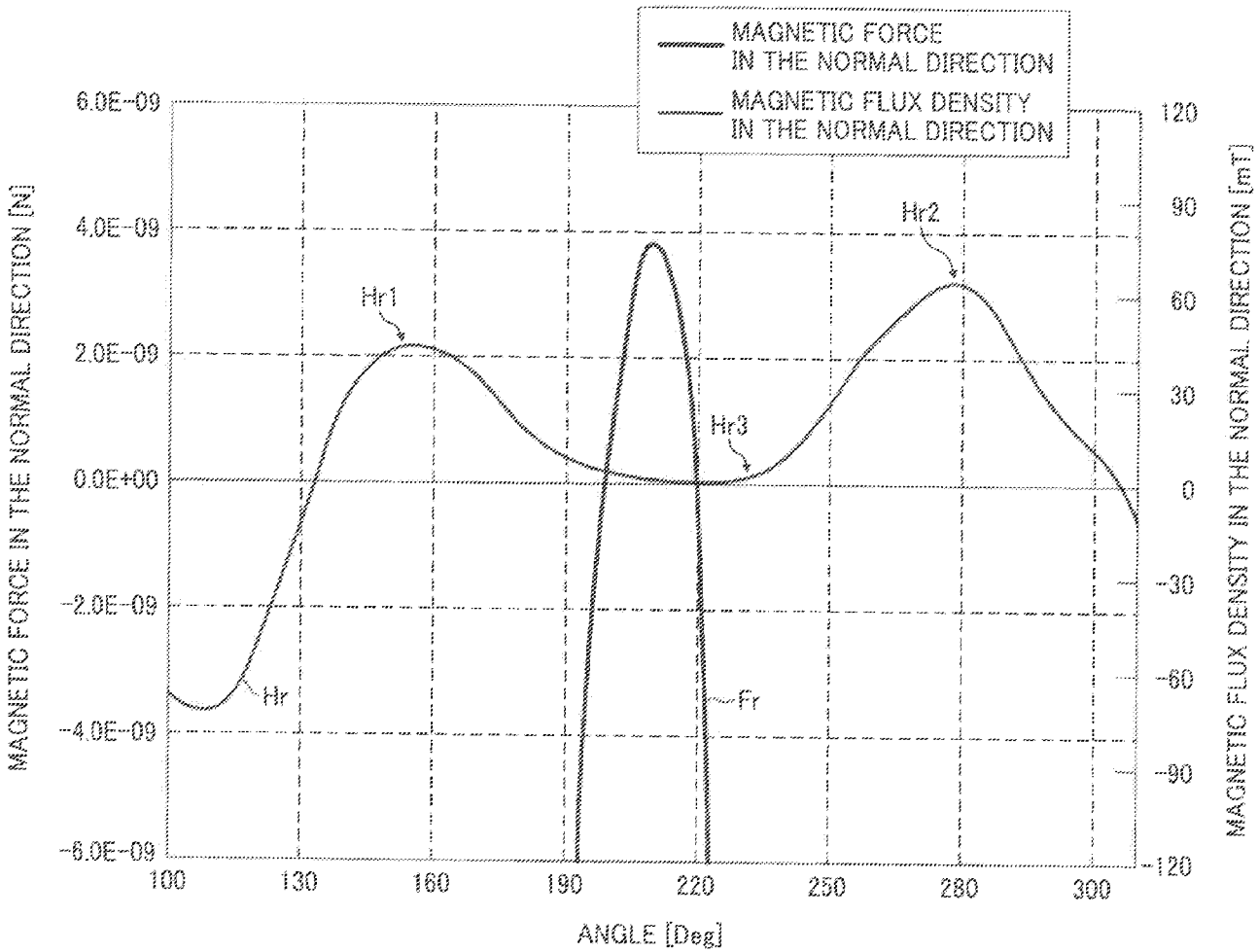
FIG. 13 is a graph indicating the magnetic flux density in the normal direction on the surface of the developing sleeve on the perimeter of the developer separation region related to yet another configuration (fine line), and the magnetic force in the normal direction on the surface of the developing sleeve (thick line)

Moreover, as indicated in FIG. 13, regarding the developer transport direction of the developing sleeve 141, a configuration is possible such that the ground point Hr3, which indicates the minimum value of the magnetic flux density Hr on the developing sleeve between the first ground point Hr1, where the magnetic flux density Hr in the normal direction of the N2 pole is the maximum on the developing sleeve and the second ground point Hr2 where the magnetic flux density Hr in the normal direction of the N3 pole is the maximum on the developing sleeve, is positioned further toward the second ground point Hr2 side than the central ground point between the first ground point Hr1 and the second ground point Hr2. The developer separation region P is thereby closer to the N3 pole, and therefore re-adhesion of developer separated from the developing sleeve 141 is unlikely to be generated.

Further, it has been demonstrated that the problem of re-adherence described above is notable at a surface movement velocity of the developing sleeve 141 is at 350 [mm/sec] or more. The present invention is thereby extremely useful if the surface movement velocity of the developing sleeve 141 is at 350 [mm/sec] or more.

Next the configuration of special parts of the present invention will be explained.

Figure 14:
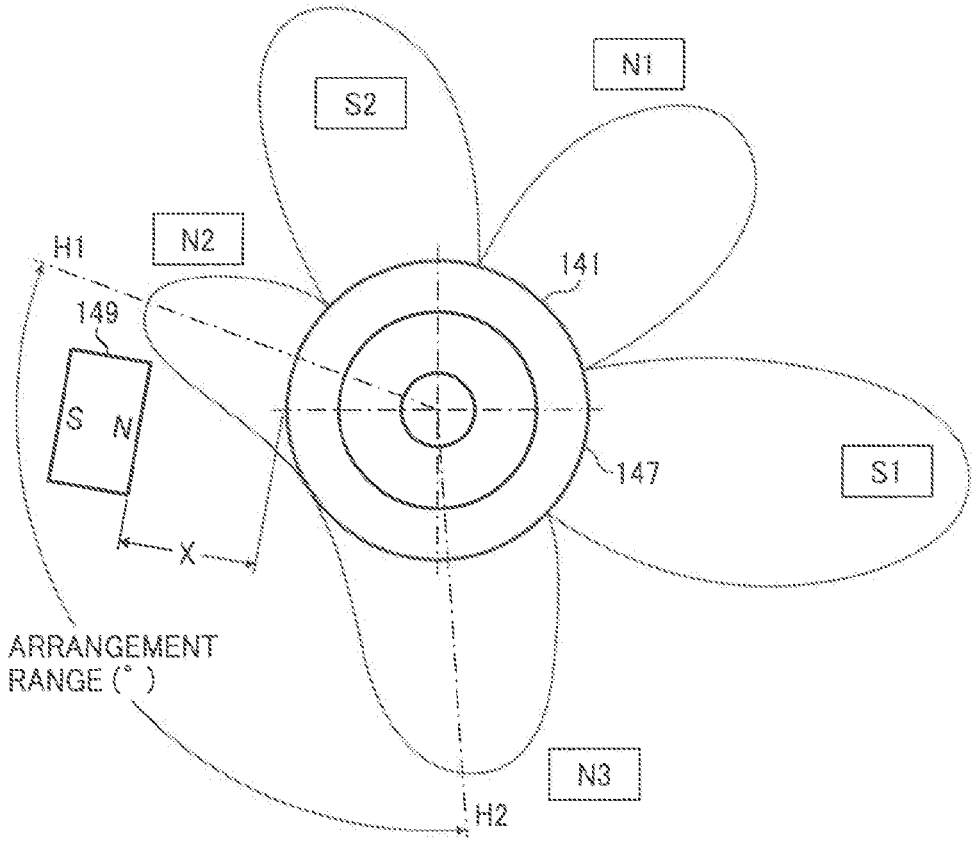
FIG. 14 is a diagram indicating an example of the arrangement of magnets relating to the developer transport direction of the developing sleeve in a developing device of the present embodiment.
Figure 15:
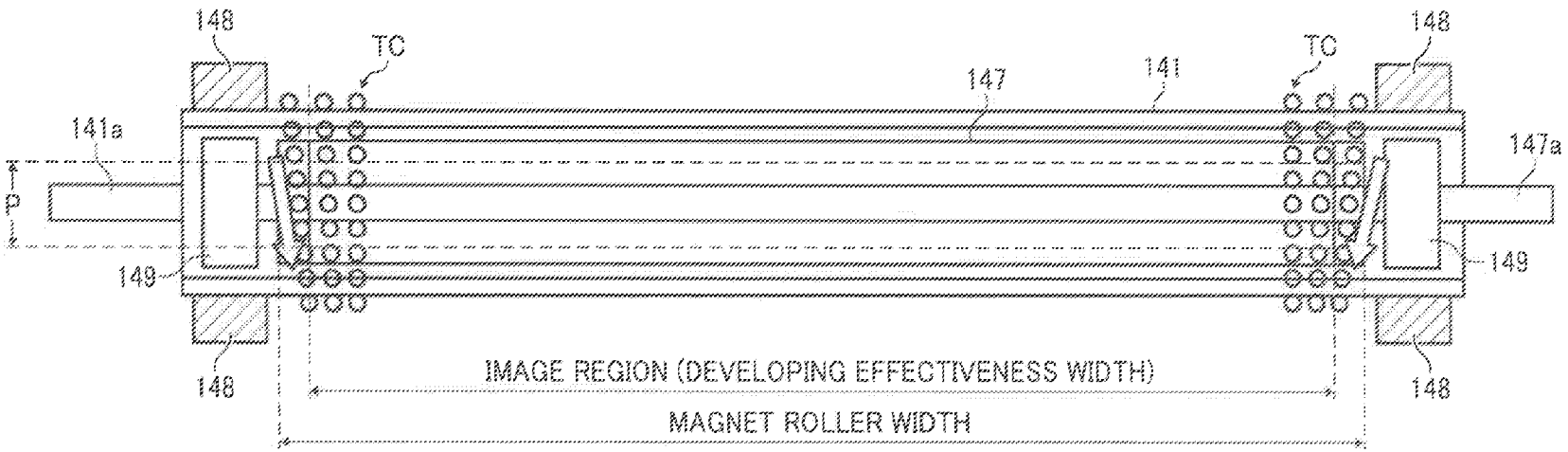
FIG. 15 is a diagram indicating an example of the arrangement of magnets relating to the axial direction of the developing sleeve of the same developing device.

Here in the present embodiment, as indicated in FIG. 7, magnets 149 are arranged as magnet members. As indicated in FIG. 14, the positions of these magnets 149 in relation to the direction of developer transport of the developing sleeve 141 are in between from the normal line H1 of the maximum ground point of magnetic flux density in the normal direction of the N2 pole on the developing sleeve up to the normal line H2 of the maximum ground point of magnetic flux density in the normal direction of the N3 pole on the developing sleeve. Moreover, as indicated in FIG. 15, the positions of these magnets 149 in relation to the axial direction of the developing sleeve 141 are further to the outside in the axial direction of the developing sleeve 141 than the region opposing the magnetic roller 147. Then, these magnets 149 are arranged to face the developer separation region P such that the facing magnetic pole has the same polarity (N polarity) as that of the N2 pole and the N3 pole.

If these magnets 149 are not set up, the kind of developer recirculation described above occurs in the axial direction end regions of the developing sleeve in the region of the peripheral surface of the developing sleeve 141 opposing the magnetic roller 147. This is because, in the developer separation region P, the magnetic force lines produced in the axial direction end regions of the developer sleeve of the region opposing the magnetic roller 147 are oriented to the outside in the axial direction of the developing sleeve, and therefore recirculation of developer is generated because the magnetic force that acts on the developer in these end regions has a large component facing to the outside in the axial direction of the developing sleeve and peeling force cannot be effectively applied to the developer.

In the present embodiment, by setting up the magnets 149 as described above, in the developer separation region P on the developing sleeve, the orientation of the magnetic force lines of the axial direction end regions of the developing sleeve within the region opposing the magnetic roller 147 can be made to approach a direction orthogonal to the axial direction of the developing sleeve. The peeling force in these end regions is thereby improved, and therefore, the peeling force acts effectively on the developer even in these end regions, and developer can be efficiently removed from the peripheral surface of the developing sleeve 141. As a result, recirculation of developer can be effectively suppressed even in these end regions.

Next, the configuration of the magnets 149 of the present embodiment will be explained in further detail by referring to FIG. 16.

Figure 16:
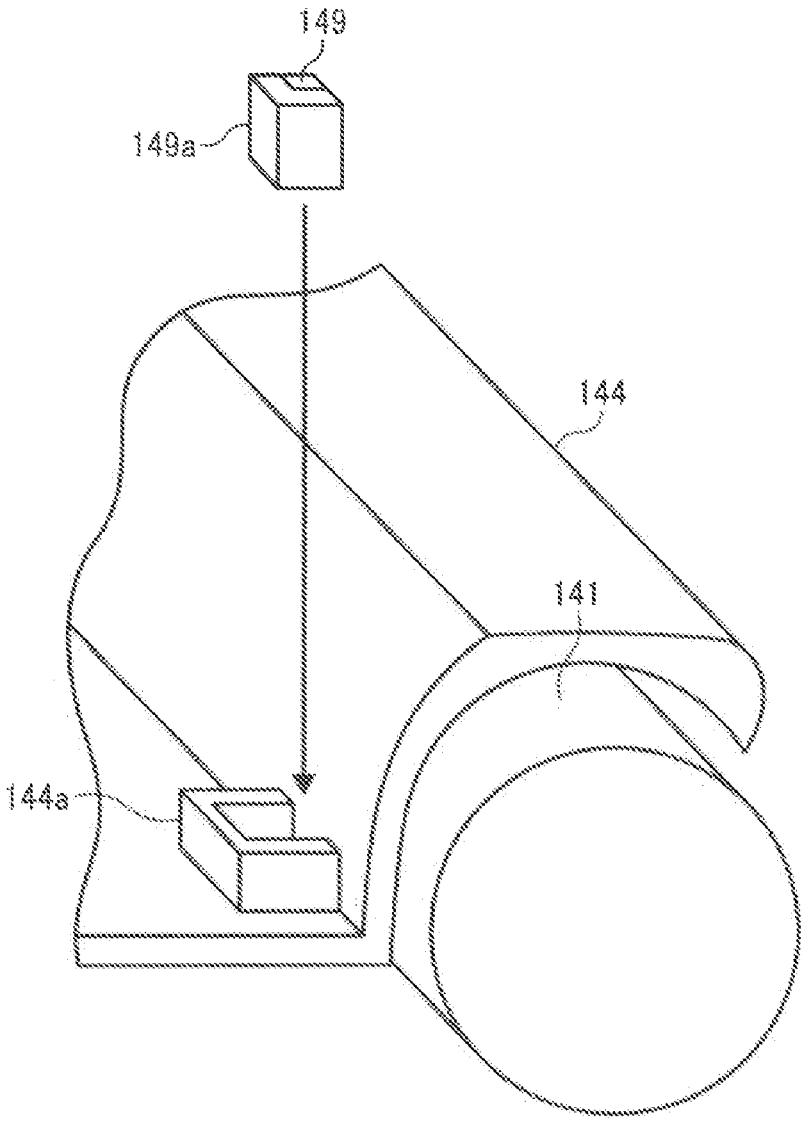
FIG. 16 is a diagram to explain the installation of magnets in 9 the same developing device.

FIG. 16 is indicates the installation of a magnet 149 in the developing device.

Magnet 149 of the present embodiment is installed on the outside of the developing device, concretely, on the outside wall of a non-magnetic casing 144, and is arranged such that the N pole surface is oriented to the developing sleeve 141 side. The casing 144 is formed of a resin such as polycarbonate, etc, and the developer housing unit is formed on the inside thereof. A rib 144*a* is provided on the exterior wall surface of the casing 144 in the position for installing the magnet 149 on the exterior wall. The magnet 149 is installed in a pocket-shaped magnet securing unit surrounded by this rib 144*a*. In the present embodiment, in order to determine the position of and retain the magnet 149 in this magnet securing unit, the magnet 149 is installed in a position determination auxiliary member 149*a* that embeds a gap between the magnet 149 and the rib 144*a*, and the magnet 149 together with the position determination auxiliary member 149*a* is configured so as to mate with the magnet securing unit. This position determination auxiliary member 149*a* is made of an elastic resin. The position determination auxiliary member 149*a* is a rectangular solid member, and when mated with the magnet securing unit a cutaway part is provided on the side opposite the developing sleeve 141, and the magnet 149 is mated into this cutaway part. The position determination auxiliary member 149*a* is mated together with the magnet 149 into the magnet securing unit with a slight amount of elastic deformation. For that reason, inside the magnet securing unit, the magnet 149 is pressed into the wall parts in the magnet securing unit opposite the developing sleeve by the restoration force of the position determination auxiliary member 149*a*, and the magnet 149 and the casing 144 have a mutual tight seal. By adopting this kind of configuration in the present embodiment, the magnetic force of the magnet 149 can effectively act even when the magnet 144 is arranged on the outside of the casing, and movement of the magnet from its initial position can be effectively prevented.

Further, if the magnet 149 is provided on the outside of the casing as in the present embodiment, there is also the added advantage that the inconvenience of developer adhering to the magnet 149 will not occur. Of course, if a stronger magnetic force from the magnet 149 is desired, the magnet 149 may also be arrange on the inside of the casing 144 (for example, inside the developer housing chamber), but in that case, there is the risk of developer adhering to the S pole surface or to the periphery of the magnet. In addition, if the magnet 149 is provided on the outside of the casing as in the present embodiment, there is also the advantage that the magnet 149 itself or magnetic powder from the magnet will not be mixed into the developer inside the developer housing chamber. Moreover, the degree of sealing to the case by the position determination auxiliary member 149*a* can be increased, and movement of the magnet can be prevented.

The magnetic pole surface of the N pole of the magnet 149 may be arranged such that the position relating to the axial direction of the developing sleeve straddles the axial direction end of the developing sleeve of the magnetic roller 147. However, in the configuration of this case, of the magnetic pole surface, the magnetic pole surface part arranged further to the outside of the developing sleeve in the axial direction than the developing sleeve axial direction end part of the magnetic roller 147 generates a stronger magnetic field than the magnetic pole surface arranged further to the inside in the axial direction of the developing sleeve than the developing sleeve axial direction end part of the magnetic roller 147 (magnetic pole part facing the region opposing the magnetic roller 147). For example, taking the magnetic pole surface of the magnet 149 N pole, the face of the magnetic pole surface part to be arranged to the outside is arranged to be wider than the face of the magnetic surface part to be arranged to the inside. Assuming this kind of configuration, even if the magnetic surface of the magnet 149 N pole has been arranged to straddle the developing sleeve axial direction end part of the magnetic roller 147, the effect is obtained that the orientation of the lines of magnetic force of the axial direction end region of the developing sleeve of the magnetic roller 147 are close to the direction orthogonal to the axial direction of the developing sleeve.

However, a configuration such as in the present embodiment in which the magnetic pole surface of the magnet 149 N pole is not arranged in a location that faces the region opposite the magnetic roller 147 has a strong effect to make the orientation of the lines of magnetic force approach the direction orthogonal to the axial direction of the developing sleeve, and can more effectively suppress recirculation of developer.

Moreover, as indicated in FIG. 15 [sic 14], in the present embodiment the position relating to the direction of developer transport by the developing sleeve 141 is from the normal line H1 of the maximum ground point of the magnetic flux density in the normal direction of the N2 pole on the developing sleeve up to the normal line H2 of the maximum ground point of the magnetic flux density in the normal direction of the N3 pole on the developing sleeve, and the seal member 148 for sealing between the peripheral surface of the developing sleeve 141 and the casing 144 of the developing device 14Y is provided in a location where the position relating to the axial direction of the developing sleeve 141 is further to the outside than the developing effectiveness region opposite the imaging region on the photosensitive drum. Then, in the present embodiment, the entire magnetic pole surface of the magnet 149 N pole is arranged in a location where the position relating to the axial direction of the developing sleeve is further to the outside than the developing sleeve axial direction inside end of the seal member 148. By making this kind of configuration, developer being stopped up in the developer housing unit by the effect of the magnetic force of the magnet 149 can be controlled even when the magnet 149 is installed.

Moreover, the present embodiment is arranged such that the magnetic pole surface of the magnet 149 N pole faces the peripheral surface of the developing sleeve 141, but that magnetic pole surface does not always have to face the peripheral surface of the developing sleeve. Consequently, for example, the magnetic pole surface of the magnet 149 N pole may also be arranged in a position where the position relating to the developing sleeve axial direction is further to the outside than the developing sleeve 141 axial direction end part. Concretely, for example, the magnet 149 is arranged on the developing sleeve axial direction outside surface of the seal member 148 so that the N pole magnetic pole surface faces to the inside in the developing sleeve axial direction. Even in this case, the effect is obtained such that the orientation of the magnetic force lines of the developing sleeve axial direction end regions of the magnetic roller 147 approaches the direction orthogonal to the developing sleeve axial direction.

Moreover, the present embodiment is configured such that the shortest distance X between the magnetic pole surface of the magnet 149 N pole and the peripheral surface of the developing sleeve 141 (refer to FIG. 14) is larger than the height of the developer that is to be carried on the developing sleeve peripheral surface part, which is that shortest distance. By using this kind of configuration, the developer on the developing sleeve when the developing sleeve 141 is rotating is not kicked by the magnetic force of the magnet 149, and the intended effect of developer separation without interference, etc. can be obtained.

A modification of the embodiment described above will be explained below.

Figure 17:
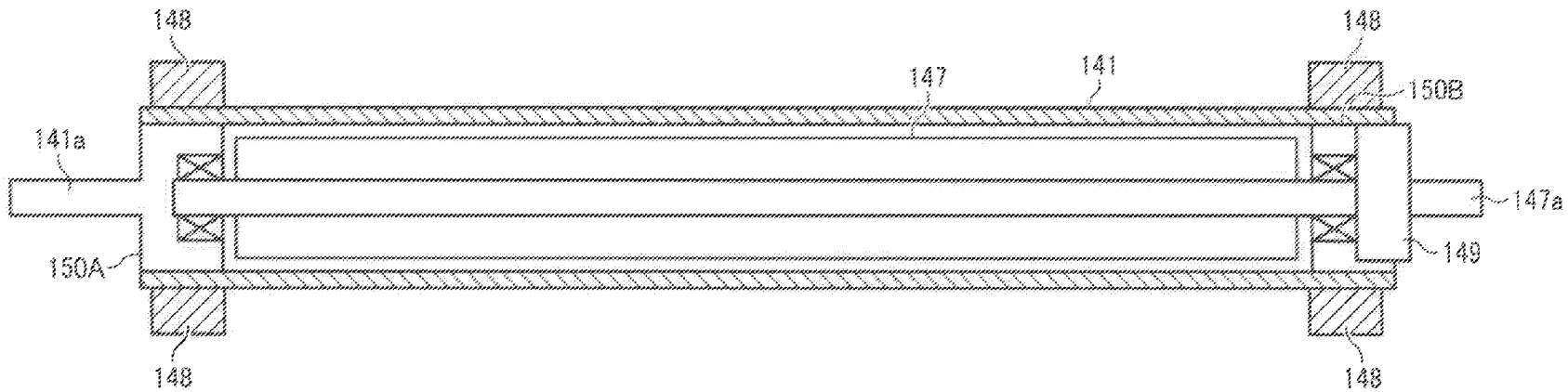
FIG. 17 is a diagram indicating the arrangement of magnets relating to the axial direction of the developing sleeve of a modification.

FIG. 17 indicates the arrangement of the magnet 149 of a modification (position relating to the axial direction of the developing sleeve).

In the present modification, one end of a magnetic roller spindle 147*a* of the magnetic roller 147 is used as one spindle end part of the developer carrier, and protrudes further to the outside in the developing sleeve axial direction than the peripheral surface end part of the developing sleeve 141. This magnetic roller spindle 147*a* is secured to the casing 144 by determining the installation angle such that the position of the S1 pole is determined at a suitable position. The developing sleeve 141 is secured by pressing into a flange 150A on the left side of the diagram, and is configured such that when the rotational spindle (sleeve spindle) 141*a* of this flange 150A is rotated, the developing sleeve 141 rotates. The developing sleeve 141 is secured by pressing into the flange 150B on the right side of the diagram, but this side rotates freely in relation to the magnetic roller spindle 147*a* seated inside the flange 150B.

In the present modification, the end part on the right side of the diagram of the magnetic roller spindle 147*a* has a part projecting to the outside of the magnetic roller 147 in the developing sleeve axial direction that is longer than the end on the left side of the diagram. In the present modification, this magnetic roller spindle 147*a* is formed of a highly rigid magnetic material (metal) in consideration of strength, etc. For that reason, in the region opposing the magnetic roller 147, the end part on the right side in the diagram, rather than the end part on the left side in the diagram, is prone to have magnetic force lines in the developing sleeve axial direction end region that turn in facing the magnetic roller spindle 147*a*. As a result, at the end part on the right side in the diagram, rather than at the end part on the left side in the diagram, the magnetic force acting on the developer in that end region has a greater component facing to the outside in the developing sleeve axial direction, and because it is difficult for the peeling force to act effectively on the developer, recirculation of developer is prone to occur.

Thus, the present modification is configured such that the magnet 149 is only provided in the end part on the right side in the diagram, and no magnet 149 is provided in the end part on the left side in the diagram. By configuring in this way, the number of magnets 149 arranged can be reduced.

Further, in the present modification, an example was given of the rotational spindle part, that protrudes further to the outside in the developing sleeve axial direction than does the region opposing the magnetic roller 147, being configured by a magnetic material, but if the strength can be guaranteed, this rotational spindle part may also be configured by a non-magnetic material such as stainless steel or aluminum. In that case, the lines of magnetic force in the developing sleeve axial direction end regions in the region opposing the magnetic roller 147 are not prone to face the outside in the developing sleeve axial direction, and recirculation of developer can be effectively controlled.

Next, tests the present inventors conducted to confirm the effects (called "experimental examples" below) will be explained.

In the present experimental example, the position of the developer carrier in the axial direction was slightly offset, and with the developing sleeve axial direction end part in the region opposing the magnetic roller 147, was positioned within the developing effectiveness region, beta images were continuously printed, and the width of the part where the image concentration declines because of developer recirculation, specifically, the width in which developing recirculation occurs (length in developing sleeve axial direction) was measured. Further, in the present experimental example, the modified developing device described above was used.

Figure 18:
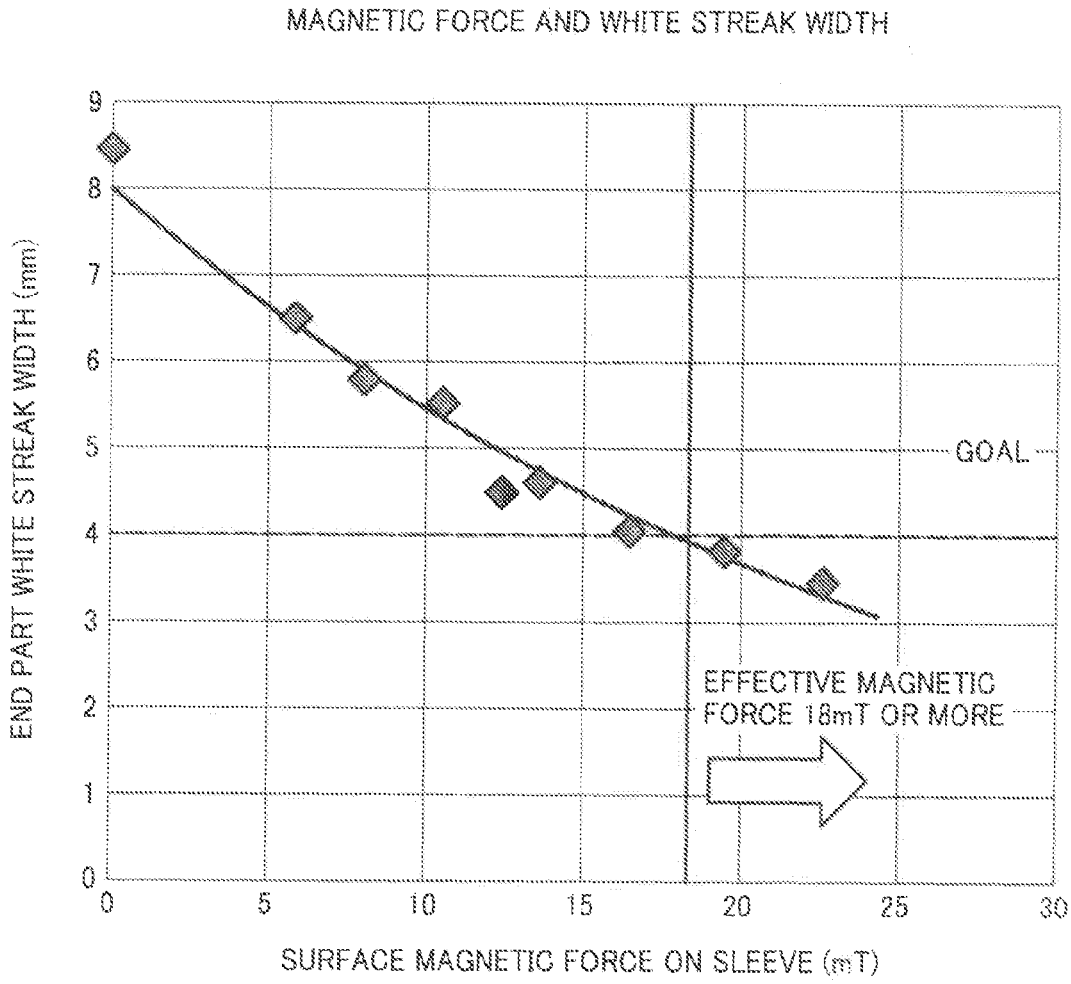
FIG. 18 is a graph indicating experimental results for an embodiment of the present invention.

FIG. 18 is a graph indicating the experimental results of the present experimental example.

This graph takes the surface magnetic force of the magnet 149 that is generated on the developing sleeve axial direction end parts in the regions opposing the magnetic roller 147 on the peripheral surface of the developing sleeve 141 as the horizontal axis, and takes the length from the image end part where developer recirculation is generated (end part white streaks) as the vertical axis. As is evident from this graph, there is roughly a proportional relationship between the aforementioned surface magnetic force and the developer recirculation generation width. If the goal is a developer recirculation generation width of 4 mm or less, then a surface magnetic force of 18 mT or more is necessary.

The developing devices 14Y, 14C, 14M and 14K related to the present embodiment (everything below also applies to the modification described above) have: a developer carrier that arranges a magnetic roller 147 as magnetic generation means inside a developing sleeve 141, which is a non-magnetic hollow body, and that uses the magnetic force of the magnetic roller 147 for carrying and transporting developer comprising magnetic carrier and toner on the peripheral surface of the developing sleeve 141; a developer housing unit that houses developer that is to be carried on the developing sleeve 141; and a doctor blade 146 as a developer restriction member to restrict the layer thickness of the developer carried on the developing sleeve 141; and developer from inside the developer housing unit that is carried on the developing sleeve 141 by the magnetic roller 147 is restricted by the doctor blade 146, is then passed through the developing region opposite the photosensitive drums 12Y, 12C, 12M, and 12K which are latent image carriers, and is again returned to inside the developer housing unit. The magnetic roller 147 is provided with an N2 pole, which is a first magnetic pole, and an N3 pole, which is a second magnetic pole, that have the same polarity (N polarity) and are adjacent to each other for generating a magnetic field for removing from the developing sleeve 141 developer that has passed through the developing region; and the N3 pole is in a position further downstream than is the N2 pole in the direction of developer transport by the developing sleeve 141.

Outside of the magnetic roller 147, the present developing devices 14Y, 14C, 14M, and 14K are provided with a magnet 149 as a magnetic member, which generates a magnetic field that displaces to the inside in the axial direction lines of magnetic force that pass through the axial direction end regions in the developer separation region P on the developing sleeve where the magnetic forces of the N2 pole and the N3 pole exert on the developer on the developing sleeve a peeling force oriented in the direction of separation from the developing sleeve. Concretely, in relation to the developer transport direction of the developing sleeve, the magnet 149 is arranged such that the position of the magnetic pole surface having the same polarity (N polarity) as that of the N2 pole and the N3 pole is in the area from the normal line H1 of the maximum ground point of magnetic flux density in the normal direction of the N2 pole on the developing sleeve up to the normal line H2 of the maximum ground point of magnetic flux density in the normal direction of the N3 pole on the developing sleeve, and in relation to the developing sleeve axial direction, is further to the outside from the axial direction end part of the magnetic roller 147.

As described above, the orientation of the lines of magnetic force in the developing sleeve axial direction end regions within the developer separation region P on the developing sleeve 141 of the region opposing the magnetic roller 147 can thereby approach a direction orthogonal to the developing sleeve axial direction. The peeling force in these end regions is thereby improved, and therefore the peeling force can act effectively on the developer even in these end regions, and the developer can be efficiently removed from the peripheral surface of the developing sleeve 141. As a result, the width where recirculation of developer is generated (length in the developer carrier axial direction) in the region opposite the magnetic roller 147 can be narrowed. Thus, even if the width of the region opposing the magnetic roller 147 is short, the same developing effectiveness width as in the past can be realized without generating image concentration irregularities caused by recirculation of developer, and a developing device that is compact in the developing sleeve axial direction can be achieved.

Further, as described above, in relation to the developing sleeve axial direction, the magnetic pole surface of the magnet 149 may be arranged to straddle across from the aforementioned position to a position that faces the region opposing the magnetic roller 147, but in that case, the configuration is such that the magnetic pole surface part arranged in the former position generates a stronger magnetic field than the magnetic pole surface part arranged in the latter position. Even with this kind of configuration, the orientation of the lines of magnetic force in the developing sleeve axial direction end regions within the developer separation region P on the developing sleeve 141 of the region opposing the magnetic roller 147 can approach a direction orthogonal to the developing sleeve axial direction.

However, the magnet 149 is preferably configured as in the present embodiment such that the magnetic pole surface is not arranged in a location facing the region opposite the magnetic roller 147. This configuration has a strong effect to make the orientation of the lines of magnetic force approach a direction orthogonal to the developing sleeve axial direction, and can more effectively suppress developer recirculation.

Moreover, in the present embodiment, the seal member 148 for sealing between the peripheral surface of the developing sleeve 141 and the casing 144 of the developing device is provided in a location where the position relating to the developer transport direction of the developing sleeve 141 is in the area from the normal line H1 of the maximum ground point of magnetic flux density in the normal direction of the N2 pole on the developing sleeve 141 up to the normal line H2 of the maximum ground point of magnetic flux density in the normal direction of the N3 pole on the developing sleeve 141, and the position relating to the axial direction of the developing sleeve 141 is further to the outside than the effective developing region that opposes the imaging region of the photosensitive drums 12Y, 12C, 12M, and 12K; and the magnet 149 is configured such that the magnetic pole surface is arranged in a location where the position relating to the axial direction of the developing sleeve 141 is further outside than the developing sleeve axial direction inside end part of the seal member 148, and there is no magnetic pole surface in a location further inside than the inside end part. According to this configuration, even if the magnet 149 is arranged in the aforementioned specified location, it is possible to prevent the magnetic force of the magnet 149 from stopping developer inside the developer housing unit.

Moreover, in the present embodiment, the magnetic pole surface of the magnet 149 is arranged in a location facing the peripheral surface of the developing sleeve 141. It is thereby not necessary to guarantee installation space for the magnet 149 outside the axial direction of the developing sleeve 141, and therefore it is easy to make the developing device compact in the developing sleeve axial direction.

Moreover, the present embodiment is configured such that the shortest distance between the magnetic pole surface of the magnet 149 and the peripheral surface of the developing sleeve 141 is greater than the height of the developer to be carried on the developing sleeve 141 peripheral surface part, which is that shortest distance, and therefore the intended effects such as developer separation without interference are obtained even with arranging the magnet 149 in the aforementioned specified location.

Further, in the present embodiment, the magnet 149 is provided outside the developing device casing 144, and therefore there is no adsorption of developer to the magnet 149 itself, and it is easy to reuse the magnet 149 when recycling the developing devices 14Y, 14C, 14M, and 14K.

In addition, in the above modification, the rotational spindle of the developer carrier (magnetic roller spindle 147*a*) was configured as a magnetic body; the lengths of the rotational spindle parts, which protrude further to the outside in the developing sleeve axial direction than does the region opposing the magnetic roller 147 were configured such that one end part in the developing sleeve axial direction was longer than the other end part; and a magnet 149 was only provided on the shorter end side and not on the longer end side. The number of magnets 149 can thereby be reduced, and costs can be cut.

Also, as explained in the experimental example above, if configured such that magnetic force of the magnetic pole surface of the magnet 149 is 18 mT or more at the developing sleeve axial direction end of the region opposing the magnetic roller 147 on the developing sleeve 141, the width where developer recirculation is generated can be kept to 4 mm or less.

In addition, in the present embodiment, the doctor blade 146 is arranged perpendicularly below the developing sleeve 141, and therefore, the N2 pole can be arranged above the upper surface of the developer in the developer housing unit. The magnet 149 can thereby be arranged above the upper surface of the developer in the developer housing unit, making it possible to prevent the developer in the developer housing unit from being drawn to and stopped by the magnet 149.

Figure 19:
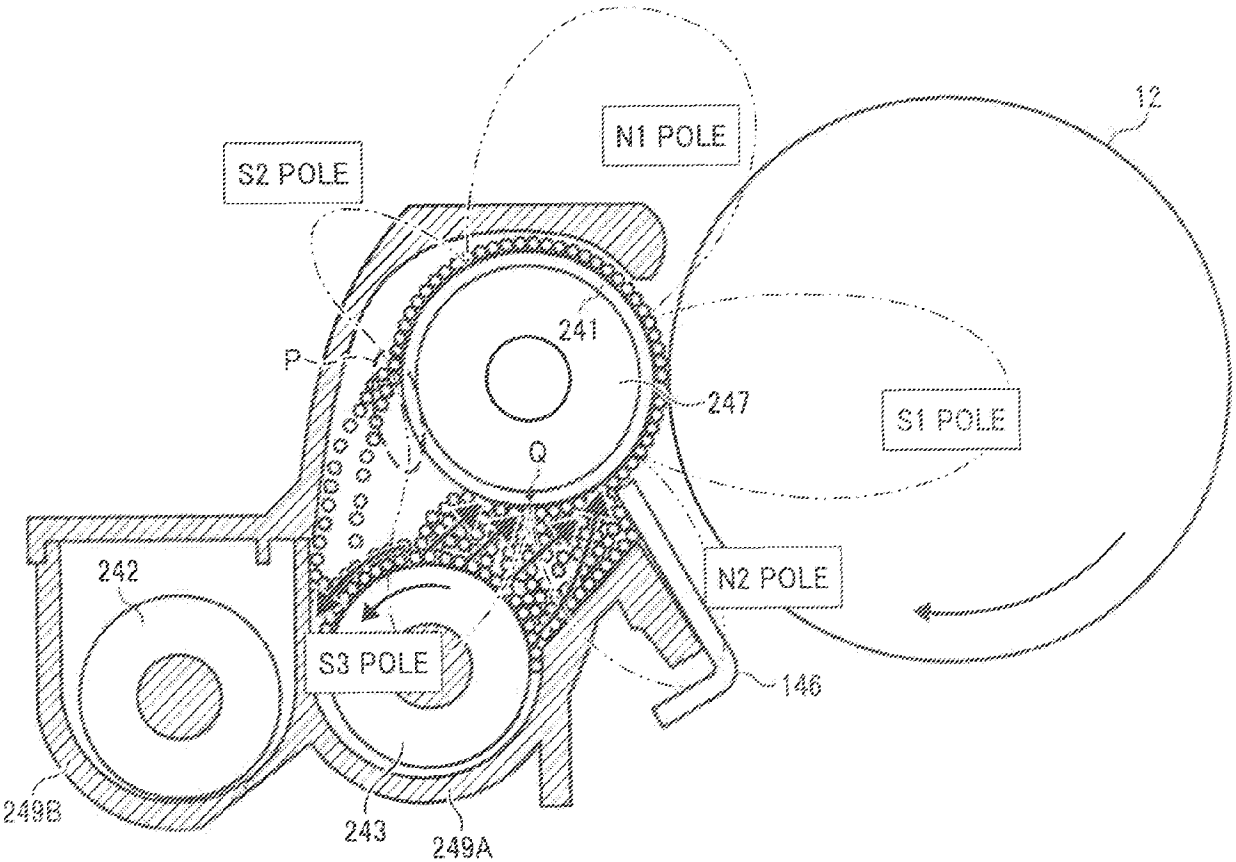
FIG. 19 is a diagram indicating the overall configuration of one example of a developing device wherein the inflection point of the magnetic field is present on the developing sleeve until the developer drawn up on the developing sleeve is restricted by the doctor blade.

Further, the present invention can be applied to the developing device indicated in FIG. 19 that has a magnetic field pole reversal point on the developing sleeve up to where the developer drawn up on the developing sleeve 141 is restricted by the doctor blade 146, as long as recirculation of developer that can be generated in the developing sleeve axial direction end regions of the region opposing the magnetic roller 147 is suppressed.

The present invention offers the superior effect of being able to make a compact developing device in the developer carrier axial direction without generating image concentration irregularities from recirculation of developer.

Various modifications will become possible for those skilled in the art after receiving the teachings of the present disclosure without departing from the scope thereof.

What is claimed is:

1. A developing device comprising:

a developer carrier, in which magnetic field generation means is arranged inside a non-magnetic hollow body, for carrying and transporting two-component developer comprising magnetic carrier and toner on the peripheral surface of said hollow body by a magnetic force of said magnetic field generation means;

a developer housing unit that houses the two-component developer to be carried on said developer carrier; and a developer restriction member for restricting a layer thickness of the two-component developer carried on said developer carrier, wherein a developing region opposite a latent image carrier through which developing region the two-component developer that has been carried on said developer carrier by the magnetic force of said magnetic field generation means from within said developer housing unit passes after being restricted by said developer restriction member and returns to within the developer housing unit, said magnetic field generation means comprises a first magnetic pole and a second magnetic pole adjacent to each other for generating a magnetic force for removing from said developer carrier the two-component developer that has passed through the developing region, said second magnetic pole is arranged further on the downstream side in a developer transport direction of said developer carrier than said first magnetic pole, and on the outside of said magnetic field generation means a magnetic member is arranged that generates a magnetic field for displacing to the inside in the developer carrier axial direction magnetic force lines, which exert on the two-component developer on said developer carrier a peeling force by said first magnetic pole and said second magnetic pole in a direction of separation from said developer carrier, and which pass through developer carrier axial direction end regions within a developer separation region on said developer carrier.

2. The developing device according to claim 1, wherein, with respect to the developer transport direction of said developer carrier, said magnetic member is arranged such that the position of a magnetic pole surface having the same polarity as that of said first magnetic pole and said second magnetic pole is in an area from a normal line of a maximum ground point of the magnetic flux density in the normal direction of said first magnetic pole on said developer carrier up to a normal line of a maximum ground point of the magnetic flux density in the normal direction of said second magnetic pole on said developer carrier, and with respect arranged to the axial direction of said developer carrier, is arranged further outside than said magnetic field generation means.

3. The developing device according to claim 2, wherein, with respect to the axial direction of said developer carrier, said magnetic pole surface of said magnetic member is arranged from said position across a position facing a region on the developer carrier corresponding to said magnetic field generation means, and is configured such that a magnetic field surface part, arranged in the position of the former, of said magnetic pole surface generates a stronger magnetic field than a magnetic pole surface part arranged in the position of the latter.

4. The developing device according to claim 2, wherein said magnetic member is configured such that said magnetic pole surface is not arranged in a location facing the region on the developer carrier corresponding to said magnetic field generation means.

5. The developing device according to claim 2, wherein, a seal member for sealing between the peripheral surface of the developer carrier and a casing of the developing device is provided in a location where the position in respect to the developer transport direction of said developer carrier is in an area from a normal line of a maximum ground point of the magnetic flux density in the normal direction of said first magnetic pole on said developer carrier up to a normal line of a maximum ground point of the magnetic flux density in the normal direction of said second magnetic pole on said developer carrier; and the position with respect to the axial direction of said developer carrier, is an area further outside than an effective developing area facing an image forming region on a latent image carrier; and said magnetic member is arranged such that the position of said magnetic pole surface with respect to the axial direction of said developer carrier is further outside than an inside end part of said seal member in the developer carrier axial direction, and the said magnetic pole surface is not in a location further inside than said inside end part.

6. The developing device according to claim 1, wherein a magnetic pole surface of said magnetic member is arranged in a location facing the peripheral surface of said developer carrier.

7. The developing device according to claim 6 configured such that the shortest distance between said magnetic pole surface of said magnetic member and the peripheral surface of said developer carrier is greater than the height of the developer to be carried on the developer carrier peripheral surface part.

8. The developing device according to claim 6, wherein said magnetic member is provided outside the casing of the developing device.

9. The developing device according to claim 1, wherein a rotational spindle of said developer carrier is configured by a magnetic body, the length of the rotational spindle that protrudes in the developer carrier axial direction further to the outside of an end part of said magnetic field generation means is longer in one end part in the developer carrier axial direction than in the other end part, and said magnetic member is provided only on said the other end part side that is longer, and not on said one end part side.

10. The developing device according to claim 1, wherein said developer restriction member is arranged perpendicularly below said developer carrier.

11. A process cartridge, which supports integrally a latent image carrier and a developing device that transports to a developing region opposing said latent image carrier a two-component developer comprising magnetic carrier and toner and that develops an image by making said toner adhere to the latent image on said latent image carrier, and which is freely attachable to and detachable from an image forming apparatus that finally transfers a toner image, obtained by developing an image by means of said developing device, from the latent image carrier onto a recording medium thereby forming an image on said recording medium, wherein said developing device comprises:

a developer carrier, in which magnetic field generation means is arranged inside a non-magnetic hollow body, for carrying and transporting two-component developer comprising magnetic carrier and toner on the peripheral surface of said hollow body by a magnetic force of said magnetic field generation means;

a developer housing unit that houses the two-component developer to be carried on said developer carrier; and a developer restriction member for restricting a layer thickness of the two-component developer carried on said developer carrier, wherein the developing region opposite the latent image carrier allows the two-component developer that has been carried on said developer carrier by the magnetic force of said magnetic field generation means from within said developer housing unit to pass after being restricted by said developer restriction member and to return to within the developer housing unit, said magnetic field generation means comprises a first magnetic pole and a second magnetic pole adjacent to each other for generating a magnetic force for removing from said developer carrier the two-component developer that has passed through the developing region, said second magnetic pole is arranged further on the downstream side in a developer transport direction of said developer carrier than said first magnetic pole, and on the outside of said magnetic field generation means a magnetic member is arranged that generates a magnetic field for displacing to the inside in the developer carrier axial direction magnetic force lines, which exert on the two-component developer on said developer carrier a peeling force by said first magnetic pole and said second magnetic pole in a direction of separation from said developer carrier, and which pass through developer carrier axial direction end regions within a developer separation region on said developer carrier.

12. An image forming apparatus, comprising a latent image carrier and a developing device that transports to a developing region opposing said latent image carrier a two-component developer comprising magnetic carrier and toner, and developing an image by making said toner adhere to the latent image on said latent image carrier, and by finally transferring a toner image obtained by development by means of said developing device from the latent image carrier to a recording medium, thereby forming an image on said recording medium, wherein said developing device comprises:

a developer carrier, in which magnetic field generation means is arranged inside a non-magnetic hollow body, for carrying and transporting two-component developer comprising magnetic carrier and toner on the peripheral surface of said hollow body by a magnetic force of said magnetic field generation means;

a developer housing unit that houses the two-component developer to be carried on said developer carrier; and a developer restriction member for restricting a layer thickness of the two-component developer carried on said developer carrier, wherein the developing region opposite the latent image carrier allows the two-component developer that has been carried on said developer carrier by the magnetic force of said magnetic field generation means from within said developer housing unit to pass after being restricted by said developer restriction member and to return to within the developer housing unit, said magnetic field generation means comprises a first magnetic pole and a second magnetic pole adjacent to each other for generating a magnetic force for removing from said developer carrier the two-component developer that has passed through the developing region, said second magnetic pole is arranged further on the downstream side in a developer transport direction of said developer carrier than said first magnetic pole, and on the outside of said magnetic field generation means a magnetic member is arranged that generates a magnetic field for displacing to the inside in the developer carrier axial direction magnetic force lines, which exert on the two-component developer on said developer carrier a peeling force by said first magnetic pole and said second magnetic pole in a direction of separation from said developer carrier, and which pass through developer carrier axial direction end regions within a developer separation region on said developer carrier.

* * * * *